US008696194B2

(12) United States Patent
Koda et al.

(10) Patent No.: US 8,696,194 B2
(45) Date of Patent: Apr. 15, 2014

(54) DETENT ESCAPEMENT AND MECHANICAL TIMEPIECE INCLUDING DETENT ESCAPEMENT

(75) Inventors: Masayuki Koda, Chiba (JP); Takashi Niwa, Chiba (JP)

(73) Assignee: Seiko Instruments Inc. (JP)

( * ) Notice: Subject to any disclaimer, the term of this patent is extended or adjusted under 35 U.S.C. 154(b) by 32 days.

(21) Appl. No.: 13/395,674

(22) PCT Filed: Aug. 31, 2010

(86) PCT No.: PCT/JP2010/064810

§ 371 (c)(1),
(2), (4) Date: May 1, 2012

(87) PCT Pub. No.: WO2011/030694

PCT Pub. Date: Mar. 17, 2011

(65) Prior Publication Data

US 2012/0218870 A1 Aug. 30, 2012

(30) Foreign Application Priority Data

Sep. 14, 2009 (JP) ..... 2009-212230

(51) Int. Cl.
*G04B 15/00* (2006.01)

(52) U.S. Cl.
USPC ..... 368/131

(58) Field of Classification Search
USPC ..... 368/127–133
See application file for complete search history.

(56) References Cited

U.S. PATENT DOCUMENTS

| | | | | |
|---|---|---|---|---|
| 6,942,378 | B2 * | 9/2005 | Hayek et al. | 368/127 |
| 7,458,717 | B2 * | 12/2008 | Baumberger et al. | 368/127 |
| 7,686,503 | B2 * | 3/2010 | Rochat et al. | 368/127 |
| 8,087,819 | B2 * | 1/2012 | Chiuve et al. | 368/127 |
| 8,491,183 | B2 * | 7/2013 | Koda et al. | 368/127 |

FOREIGN PATENT DOCUMENTS

| | | |
|---|---|---|
| JP | 2005181318 | 7/2005 |
| JP | 2006169620 | 6/2006 |
| JP | 2007070678 | 3/2007 |
| JP | 2007070709 | 3/2007 |

OTHER PUBLICATIONS

George Daniel, "The Practical Watch Escapement", Premeir Print Limited, 1994 (First Edition), pp. 39-47.

* cited by examiner

*Primary Examiner* — Sean Kayes
(74) *Attorney, Agent, or Firm* — Adams & Wilks

(57) ABSTRACT

A detent escapement 100 includes an escape wheel 110, a balance 120 which has an impulse pallet 122 and an unlocking stone 124, and a blade 130 which has a locking stone 132. A one side actuating spring 140 which can contact the unlocking stone 124 is provided in the blade 130. When a working reference line 129, which is a line connecting the rotation center of the balance 120 and the rotation center of the blade 130, is set to a reference, the one side actuating spring 140 is disposed at an angle so that a distance of the tip of the one side actuating spring from the working reference line is increased as the tip is separated from the rotation center of the balance 120 in a side opposite to the side at which the escape wheel 110 is present. The one side actuating spring 140 is disposed between the locking stone support arm 131 and the one side actuating spring support arm 133.

13 Claims, 34 Drawing Sheets

DETENT ESCAPEMENT AND MECHANICAL TIMEPIECE INCLUDING DETENT ESCAPEMENT

CROSS-REFERENCE TO RELATED APPLICATIONS

This application is a U.S. national stage application of International Application No. PCT/JP2010/064810 filed Aug. 31, 2010, claiming a priority date of Sep. 14, 2009, and published in a non-English language.

TECHNICAL FIELD

The present invention relates to a detent escapement and a mechanical timepiece including the detent escapement. Particularly, the present invention relates to a detent escapement which is configured so as to be capable of being thinned while decreasing energy loss of a balance, and a mechanical timepiece including the novel detent escapement.

BACKGROUND ART

In the related art, as one type of an escapement of a mechanical timepiece, a "detent escapement" (chronometer escapement) is known. As a representative mechanism form of the detent escapement, conventionally, a spring detent escapement and a pivoted detent escapement have been widely known (for example, refer to NTL 1 below).

Referring to FIG. 32, the conventional spring detent escapement 800 includes an escape wheel 810, a balance 820, a detent lever 840, and a balance spring 830 which is configured of a plate spring. An impulse pallet 812 is fixed to a roller table of the balance 820. A locking stone 832 is fixed to the detent lever 840.

Referring to FIG. 33, the conventional pivoted detent escapement 900 includes an escape wheel 910, a balance 920, a detent lever 930, and a balance spring 940 which is configured of helical spring (spiral spring). An impulse pallet 912 is fixed to a roller table of the balance 920. A locking stone 932 is fixed to the detent lever 930.

Unlike a club tooth lever escapement which is widely used currently, as characteristics common to the above-described two types of escapement, since power is directly transmitted from the escape wheel to the balance, there is an advantage in that a loss of the power (transmission torque) in the escapement can be decreased.

The conventional first type of detent escapement includes a detent lever, a helical spring (spiral spring), and a plate spring (for example, refer to PTL 1 below).

The conventional second type of detent escapement includes a major roller (4) which supports a first finger (14), a determent member (6) which supports a second finger (11) and a determent pawl stone (7), and a small roller (23) which performs the position control of the determent member (6). The detent escapement does not include a return spring (for example, refer to PTL 2 below).

The conventional third type of detent escapement includes an escape wheel (1), a balance, a detent (11) which supports a stop pawl (21), and a restricting plate (5) which is fixed to the balance. The detent escapement includes a balance spring (12) in which the inner end is integrated to the detent (11) (for example, refer to PTL 3 below).

The conventional method for manufacturing electroformed components such as a pallet fork and the escape wheel includes a process that forms an etching hole on a substrate having a mask, a process that inserts a lower shaft portion including a tip of the lower shaft portion of a shaft component into the etching hole of the substrate, and a process that performs an electroforming process with respect to the substrate to which a portion of the shaft component is inserted and forms an electroforming metal portion which is integrated to the shaft component (for example, refer to PTLs 4 to 7 below).

CITATION LIST

Patent Literature

PTL 1: Swiss Patent No. CH 3299 (Pages 1 and 2, and FIGS. 1 and 2)
PTL 2: JP-A-2005-181318 (Pages 4 to 7 and FIGS. 1 to 3)
PTL 3: JP-T-2009-510425 (Pages 5 to 7 and FIG. 1)
PTL 4: JP-A-2005-181318 (Abstract, Pages 7 and 8, and FIG. 1)
PTL 5: JP-A-2006-169620 (Abstract, Pages 5 to 8, and FIG. 1)
PTL 6: JP-A-2007-70678 (Abstract, Pages 5 to 9, and FIGS. 1 and 2)
PTL 7: JP-A-2007-70709 (Abstract, Pages 5 to 8, FIGS. 1 and 2)

Non Patent Literature

NFL 1: Pages 39 to 47, "The Practical Watch Escapement", Premier Print Limited, 1994 (First Edition), written by George Daniel

SUMMARY OF INVENTION

Technical Problem

In the conventional pivoted detent escapement and the conventional spring detent escapement, there are the following problems. Specifically, the balance is rotated from the initial position, the unlocking stone which is provided at the balance contacts the plate spring, and the plate spring is bent in a direction in which the plate spring is separated from the escape wheel. The detent lever and the locking stone which is included in the detent lever are also rotated in the direction to which both are separated from the escape wheel by the bending of the plate spring, and the locking stone releases the rotation of the escape wheel. Thereafter, the balance performs a free oscillation and is rotated in the reverse direction again, the unlocking stone of the balance contacts the tip of the plate spring, and the balance returns to the initial position. The operation is repeated.

In the conventional pivoted detent escapement, since the plate spring is provided along a virtual line which passes a rotation center of the balance and a supporting point of the detent lever, a contact time between the unlocking stone of the balance and the tip of the plate spring becomes long at the time of the reverse rotation of the balance, and there is a problem in that the energy loss of the balance cannot be decreased.

On the other hand, if the plate spring is obliquely provided with respect to the virtual line, the contact time between the unlocking stone of the balance and the tip of the plate spring becomes short at the time of the reverse rotation of the balance, and the energy loss of the balance can be decreased. However, in order to obliquely provide the plate spring with respect to the virtual line, the plate spring must be crossed with respect to the detent lever. Thereby, both thicknesses of the detent lever and the plate spring exist in the crossed portion, and the entire escapement cannot be made thin.

Therefore, the present invention is made with consideration for above-described problems, and an object thereof is to provide a detent escapement capable of decreasing the energy loss of the balance at the time of the reverse rotation of the balance and making the entire detent escapement thinner.

Solution to Problem

In the present invention, a detent escapement for a timepiece includes an escape wheel, a balance which has an impulse pallet which can contact a wheel tooth of the escape wheel and an unlocking stone, and a blade which has a locking stone which can contact the wheel tooth of the escape wheel, wherein the blade is configured so as to include a locking stone support arm which supports the locking stone, a one side actuating spring which includes a portion capable of contacting the unlocking stone, and a one side actuating spring support arm which determines a position of an unlocking stone contact portion which is positioned in a tip of the one side actuating spring. The blade is configured so as to be rotated in two directions which include a direction in which the locking stone approaches the escape wheel and a direction in which the locking stone is separated from the escape wheel. When a working reference line, which is a line connecting the rotation center of the balance and the rotation center of the blade, is set to a reference, the one side actuating spring is disposed at an angle so that a distance of the tip of the one side actuating spring from the working reference line is increased as the tip is separated from the rotation center of the balance in a side opposite to the side at which the escape wheel is present.

A deforming spring portion of the one side actuating spring is disposed between the locking stone support arm and the one side actuating spring support arm. According to this configuration, energy loss when the balance is returned is decreased, and it is possible to realize a thin detent escapement.

In the detent escapement of the present invention, it is preferable that a lower surface of the one side actuating spring support arm and a lower surface of the one side actuating spring are positioned in one plane perpendicular to the rotational center axis line of the escape wheel and the rotational center axis line of the balance. According to this configuration, it is possible to realize a thin detent escapement.

In the detent escapement of the present invention, it is preferable that a portion, which is continuous to the unlocking stone contact portion of the deforming spring portion of the one side actuating spring, is configured so as to have an angle which is a range of 5° to 45° with respect to the working reference line. According to this configuration, energy loss when the balance is returned is decreased, and it is possible to realize a thin detent escapement.

In the detent escapement of the present invention, the locking stone support arm may be configured so as to be positioned at a side opposite to the one side actuating spring support arm with respect to the working reference line. According to this configuration, the balance between the locking stone support arm and the one side actuating spring support arm can be achieved. That is, the position of the center of gravity of the blade is close to the rotation center of the blade, and the balance in the position of the center of gravity can be corrected. According to this configuration, it is possible to decrease the error influence on the timing rate due to the direction difference in the vertical posture of the timepiece.

In the detent escapement of the present invention, a width of the locking stone support arm may be formed so as to be greater than a width of the one side actuating spring support arm, or a thickness of the locking stone support arm may be formed so as to be thicker than a thickness of the one side actuating spring support arm. According to this configuration, the balance between the locking stone support arm and the one side actuating spring support arm can be achieved. That is, the position of the center of gravity of the blade is positioned on the working reference line or the position of the center of gravity of the blade is close to the working reference line, and the balance in the position of the center of gravity can be corrected.

In the detent escapement of the present invention, at least one of the locking stone support arm and the one side actuating spring support arm may include hollowed out portions in order to decrease the moment of inertia of the blade. According to this configuration, it is possible to effectively decrease the moment of inertia of the blade.

In addition, in the detent escapement of the present invention, the one side actuating spring support arm may be formed in a shape which includes one or more curved portions so as to be convex when viewed from the working reference line. According to this configuration, the interference between the one side actuating spring support arm and the locking stone support arm can be reliably avoided, the distance from the tip of the one side actuating spring support arm to the supporting point of the one side actuating spring can be the shortest distance, and the moment of inertia of the blade can be decreased.

Moreover, in the detent escapement of the present invention, the one side actuating spring support arm may be configured so that the cross-sectional area thereof is increased from the tip toward the base portion. According to this configuration, the moment of inertia of the one side actuating spring support arm can be decreased, and it is possible to prevent the base portion of the one side actuating spring support arm from being damaged.

In the detent escapement of the present invention, a width of the locking stone support arm is formed so as to be thinner than that of the one side actuating spring support arm, and the one side actuating spring support arm is configured so as to include a portion in which a material is removed. According to this configuration, the balance between the locking stone support arm and the one side actuating spring support arm can be achieved. That is, the position of the center of gravity of the blade is positioned on the working reference line or the position of the center of gravity of the blade is close to the working reference line, and the balance in the position of the center of gravity can be corrected. According to this configuration, it is possible to decrease the error influence on the timing rate due to the direction difference in the vertical posture of the timepiece. In addition, the moment of inertia of the blade can be decreased by forming the material-removed portion.

The detent escapement of the present invention may further include a balance spring that applies the force, which rotates the blade in the direction in which the locking stone approaches the escape wheel, to the blade, wherein the balance spring may be configured so as to be disposed so as to be positioned at the side opposite to the locking stone support arm and the one side actuating spring support arm with respect to the rotation center of the blade. According to this configuration, the balance between the locking stone support arm and the one side actuating spring support arm can be achieved. That is, the position of the center of gravity of the blade is close to the rotation center of the blade, and the balance in the position of the center of gravity can be corrected. According to this configuration, it is possible to decrease the error influence on the timing rate due to the direction difference in the vertical posture of the timepiece.

In the detent escapement of the present invention, a balance spring adjustment eccentric pin that adjusts an initial position of the balance spring may be provided. According to this configuration, it is possible to easily, rapidly and reliably adjust the initial position of the balance spring.

In the detent escapement of the present invention, it is preferable that a one side actuating spring regulating lever that presses the unlocking stone contact portion of the one side actuating spring to the one side actuating spring support arm is provided in the blade. According to this configuration, it is possible to easily, rapidly and reliably adjust the initial position of the blade.

Moreover, in the present invention, a mechanical timepiece is configured so as to include a mainspring which configures an energy source of the mechanical timepiece, a gear train which is rotated by a rotational force when the mainspring is rewound, and an escapement that controls the rotation of the gear train, wherein the escapement is configured of the above-described detent escapement. According to this configuration, it is possible to realize the mechanical timepiece which is thin and is easily adjusted. Moreover, since the mechanical timepiece of the present invention includes an improved force transmission efficiency of the escapement, in a club tooth lever escapement which is widely used as the escapement of the mechanical timepiece currently, the mainspring can be smaller, or a long-lasting timepiece can be realized by using the barrel drum of the same size.

Advantageous Effects of Invention

In the conventional detent escapement, the amount of engagement between the one side actuating spring and the unlocking stone is decreased when the balance is returned. Therefore, in order to decrease the energy loss of the balance, the structure is adopted in which the one side actuating spring and the blade do not have the same plane as each other but are divided into two layers and crossed to each other. In the detent escapement of the present invention, the one side actuating spring support arm and the one side actuating spring are provided so as to be an angle with respect to the line which connects the rotation center of the balance staff and the rotation center of the blade and so as to be disposed in the same plane as each other. Accordingly, in the detent escapement of the present invention, the energy loss of the balance can be decreased, and thinning of the timepiece movement on which the detent escapement is mounted can be improved.

In addition, in the detent escapement of the present invention, the locking stone support arm is configured so as to be curved at the side opposite to the one side actuating spring support arm. Moreover, in one preferable structure of the detent escapement of the present invention, the thickness of the locking stone support arm is configured so as to be different from the thickness of the one side actuating spring support arm. Moreover, in one preferable structure of the detent escapement of the present invention, at least one side of a portion of the locking stone support arm and a portion of the one side actuating spring support arm is configured so as to be material-removed. According to this configuration, the weight of the blade can be decreased, and the moment of inertia of the blade can be decreased. In addition, in one preferable structure of the detent escapement of the present invention, the balance spring is disposed so as to be positioned at the side opposite to the locking stone support arm and the one side actuating spring support arm with respect to the rotation center of the blade. According to this configuration, the moment of inertia of the blade can be decreased.

According to the above-described configurations, the position of the center of gravity of the blade can be disposed on the blade shaft (rotation center), or the position of the center of gravity of the blade can be disposed in the vicinity of the blade shaft (rotation center). As the position of the center of gravity of the blade approaches the blade shaft, the moment of inertia of the blade is decreased and the blade is easily rotated. Therefore, according to this configuration, the original position return of the blade due to the posture difference at the time of the vertical posture of the movement can be rapidly performed, and the timing error of the original position return of the blade due to the posture difference of the time of the vertical posture can be decreased. Thereby, the amount of engagement between the locking stone and the wheel tooth of the escape wheel can be secured even though the posture is different.

In the conventional detent escapement, particularly, in the spring detent, the blade is large with respect to the balance spring portion and becomes a so-called oversized head. Therefore, due to the fact that the center of gravity is not present at the blade rotation center, the blade receives the influence of the position of the gravity even when the escape wheel is released, the posture in which the escape wheel is easily released, and the posture in which the escape wheel is difficult to be released are generated. Thereby, the energy loss of the balance is generated due to the posture difference. In contrast, in the detent escapement of the present invention, since the balance between the locking stone support arm and the one side actuating spring support arm can be achieved, the position of the center of gravity of the blade can be disposed in the position of the vicinity of the blade shaft (rotation center axis of the blade). Thereby, it is possible to decrease influence of the moment of inertia of the blade due to the posture difference in the vertical posture.

DETAILED DESCRIPTION OF INVENTION

Hereinafter, embodiments of the present invention will be described based on the accompanying drawings. In general, a mechanical body including a driving portion of a timepiece is referred to as a "movement". A state where a dial and a pointer are mounted on the movement and inserted into a timepiece case to achieve a finished product is referred to as a "complete". In both sides of a main plate which configures a substrate of the timepiece, a side on which a glass of the timepiece case is disposed, that is, a side on which the dial is disposed, is referred to as a "back side" of the movement, a "glass side", or a "dial side". In both sides of the main plate, a side in which a case back of the timepiece case is disposed, that is, the side opposite to the dial, is referred to as a "front side" of the movement or a "case back side". A train wheel which is incorporated into the "front side" of the movement is referred to as a "gear train". A train wheel which is incorporated into the "back side" of the movement is referred to as a "back wheel train".

Figure 1:
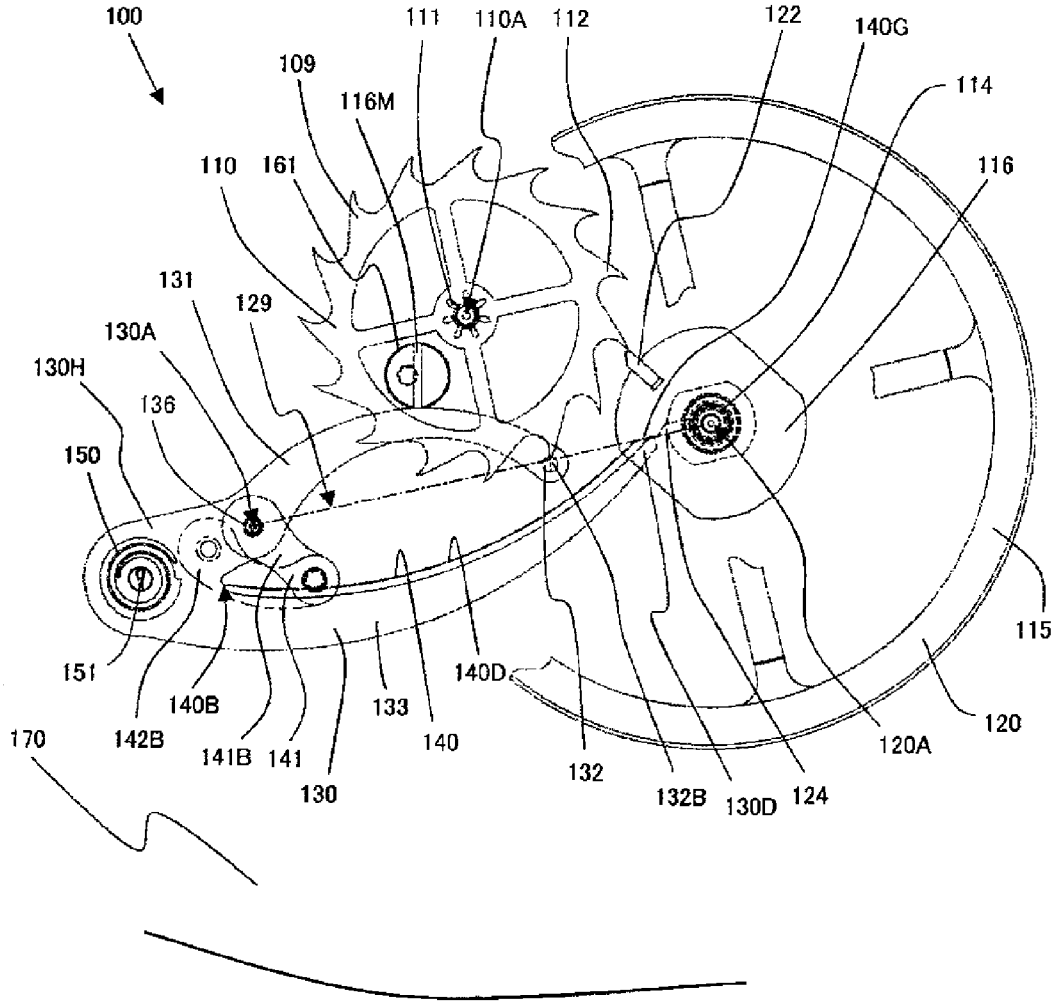
FIG. 1 is a front plan diagram showing a structure of an escapement in an embodiment of a detent escapement having a first blade structure of the present invention.
Figure 2:
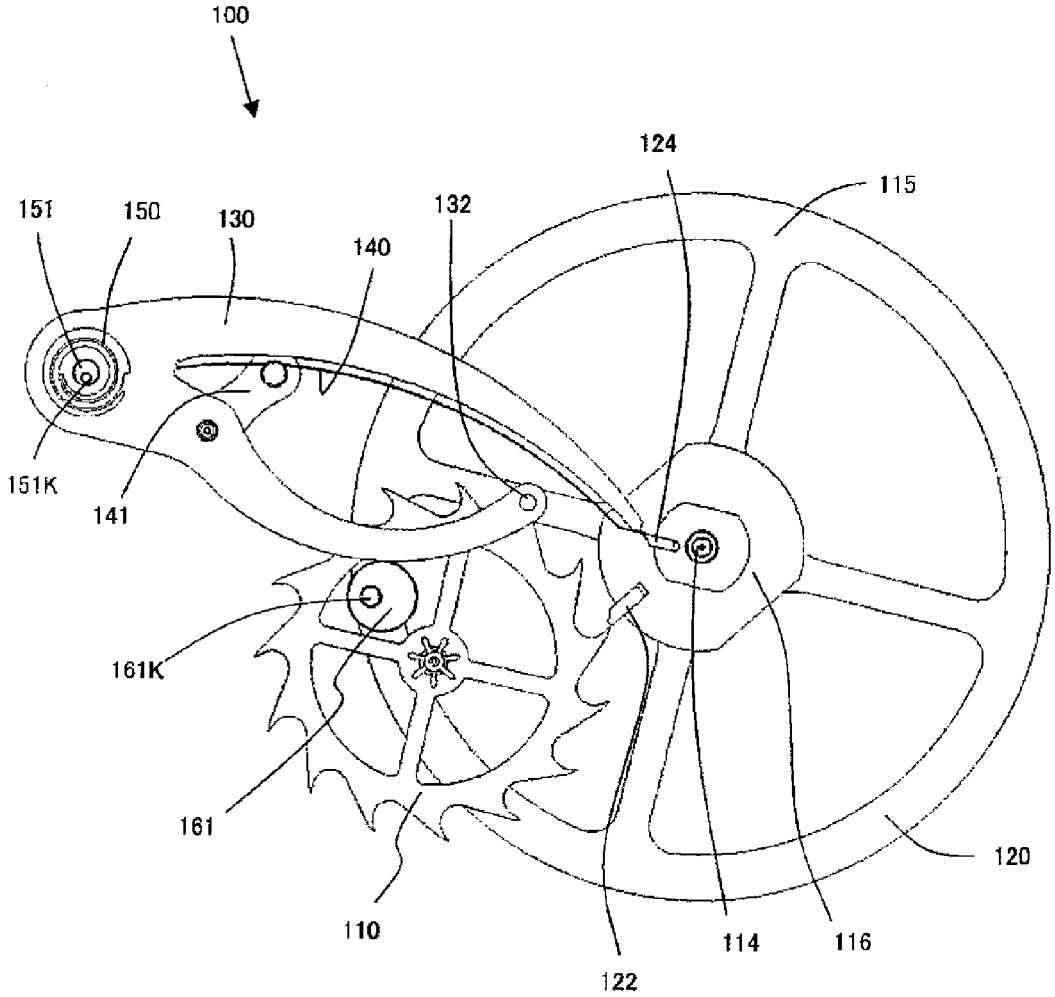
FIG. 2 is a rear plan diagram showing the structure of the escapement in the embodiment of the detent escapement of the present invention.
Figure 3:
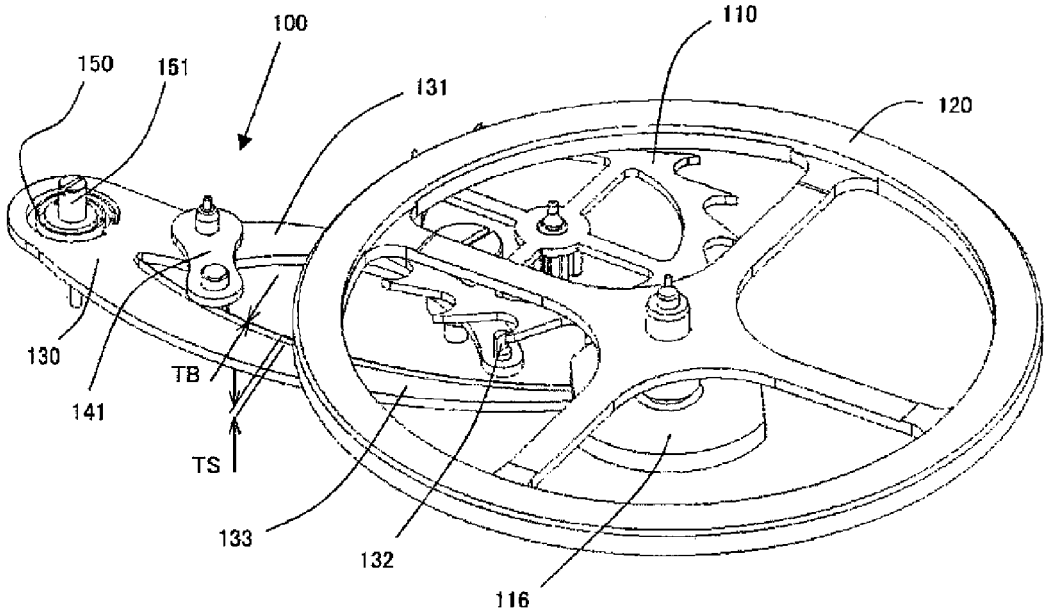
FIG. 3 is a perspective diagram showing the structure of the escapement in the embodiment of the detent escapement of the present invention.

(1) Configuration of Detent Escapement of the Present Invention:

Referring to FIGS. 1 to 3, the detent escapement 100 of the present invention includes an escape wheel 110, a balance 120 which has an impulse pallet 122 which can contact a wheel tooth 112 of the escape wheel 110 and an unlocking stone 124, and a blade 130 which has a locking stone 132 including a contact plane 132B which is capable of contacting the wheel tooth 112 of the escape wheel 110.

The blade 130 includes a locking stone support arm 131 which supports the locking stone 132, a one side actuating spring 140 which includes a portion capable of contacting the unlocking stone 124, a one side actuating spring support arm 133 for determining a position of an unlocking stone contact portion 140G of the one side actuating spring 140, and a balance spring 150. One end of the one side actuating spring 140 is fixed to the blade 130, and one end of the balance spring 150 is fixed to the blade 130. Alternatively, the one side actuating spring 140 and the balance spring 150 are integrally formed to the blade 130.

The blade 130 is configured so as to be rotated in two directions which include a direction in which the locking stone 132 approaches the escape wheel 110 and a direction in which the locking stone 132 is separated from the escape wheel 110. A base portion or supporting point 140B of the one side actuating spring 140 is disposed at a position which is positioned at a release side with respect to the rotation center 130A of the blade 130. A deforming spring portion 140D of the one side actuating spring is disposed between the locking stone support arm 131 and the one side actuating spring support arm 133. When a working reference line 129, which is a line connecting the rotation center 120A of the balance 120 and the rotation center 130A of the blade 130, is used as a reference, the one side actuating spring 140 is disposed at an angle so that a distance of the tip of the one side actuating spring from the working reference line 129 is increases as the tip is separated from the rotation center 120A of the balance 120 on a side opposite to the side at which the escape wheel 110 is present. Also, as illustrated in the drawings, the one side actuating spring 140 is configured and arranged such that the base portion 140B is disposed completely on the side opposite to the side of the escape wheel 110 with respect to the working reference line 129.

A portion, which is continuous to an unlocking stone contact portion 140G of the deforming spring portion 140D of the one side actuating spring, is configured so as to have an angle DG with respect to the working reference line 129 which is the line connecting the rotation center 120A of the balance 120 and the rotation center 130A of the blade 130. The angle DG is preferably a range of 5° to 45° and more preferably a range of 5° to 30°.

In the conventional pivoted detent escapement and the conventional spring detent escapement, the weight of the escapement tends to be heavier. In addition, when obtaining a lay out of the escapement which decreases the resistance due to the one side actuating spring and the interval interfering with the free oscillation when the balance returns, the total thickness of the escapement on the structure becomes thicker. Moreover, since the blade is large in the conventional spring detent escapement, the detent escapement becomes a so-called oversized head and the position of the center of gravity tends to be leaned forward.

In contrast, in the detent escapement of the present invention, the lower surface (that is, the surface of the main plate side) of the one side actuating spring support arm 133 and the lower surface (that is, the surface of the main plate side) of the one side actuating spring 140 are configured so as to include a portion which is positioned in one plane perpendicular to the rotational center axis line 110A of the escapement wheel 110 and the rotational center axis line of the balance 120. According to this configuration, a thin detent escapement can be realized.

For example, it is preferable that the one side actuating spring 140 is configured of a plate spring of an elastic material such as nickel, phosphor bronze, or stainless steel. The one side actuating spring 140 includes the deforming spring 140D and the unlocking stone contact portion 140G. It is preferable that the direction of the lateral direction thickness (bending direction) of the deforming spring portion 140D of the one side actuating spring 140 is a direction which is perpendicular to the rotational center axis line 130A of the blade 130. For example, it is preferable that the lateral direction thickness TB of the deforming spring portion 140D of the one side actuating spring 140 is formed so as to be 0.03 mm to 0.3 mm. For example, it is preferable that the vertical direction thickness TS of the blade 130 is formed so as to be 0.05 mm to 0.5 mm. The deforming spring portion 140D of the one side actuating spring 140 may be configured so that a ratio TS/TB (aspect ratio) of the vertical direction thickness TS and the lateral direction thickness TB is about 1 to 5.

The balance spring 150 is provided on the blade 130 in order to apply the force, which rotates the blade 130 in the direction in which the locking stone 132 approaches the escape wheel 110, to the blade 130. For example, it is preferable that the balance spring 150 is configured of a spiral spring of an elastic material such as nickel, phosphor bronze, stainless steel, elinvar, or co-elinvar. Alternatively, it is preferable that the balance spring 150 is configured of a plate spring or a wire spring. The outer peripheral edge of the balance spring 150, which is configured of a spiral spring, is fixed to the blade 130. Alternatively, the balance spring 150 configured of a spiral spring is integrally formed with the blade 130.

Figure 11:
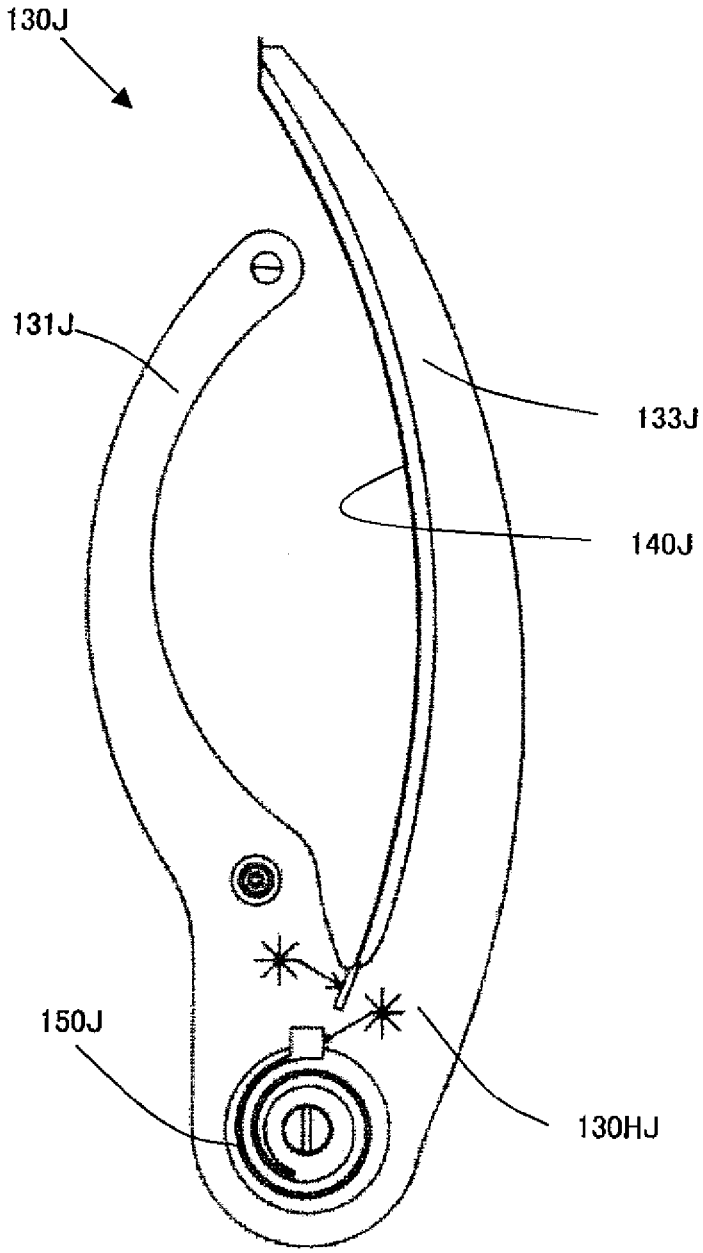
FIG. 11 is a plan diagram a ninth showing the structure of the blade in the embodiment of the detent escapement of the present invention.
Figure 14:
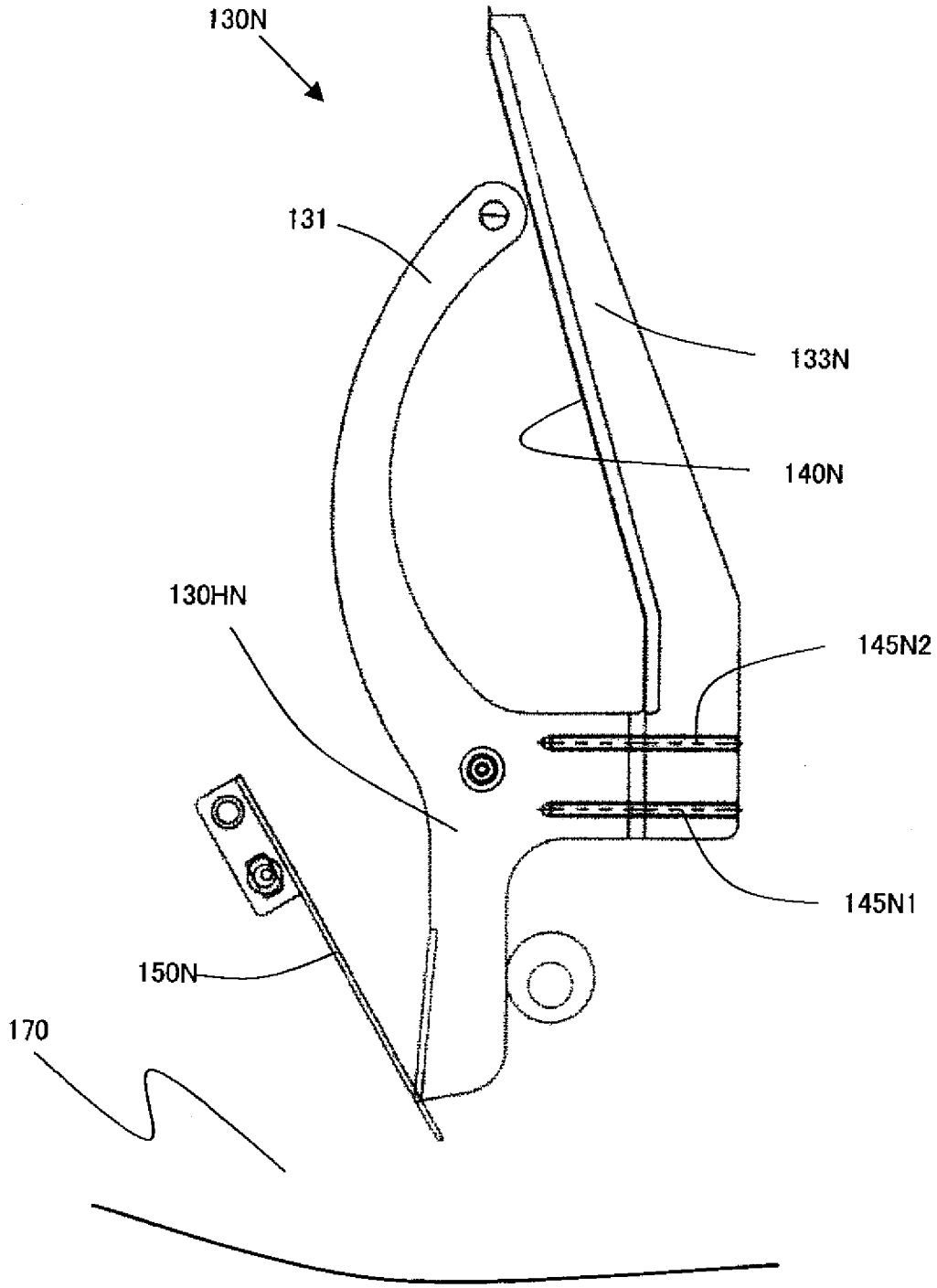
FIG. 14 is a plan diagram showing a twelfth structure of the blade and the structure of the balance spring including the pressurization adjustment mechanism in the embodiment of the detent escapement of the present invention.

On the other hand, in the detent escapement disclosed in PTL 2, the balance spring does not exist, and the position control of the stationary member 6 is performed by the smaller roller 23, the first FIG. 14, and the second FIG. 11. Compared to the control of using the balance spring, in the conventional detent escapement, the interval (angle range), which impedes the free oscillation of the balance due to the sliding with respect to the amplitude of the balance, is set to be very great. Therefore, it is considered that this configuration is disadvantageous on the timing accuracy of the timepiece.

Moreover, in the conventional detent escapement, since there are several components, error is generated in the assembly of the detent escapement, and there is a concern that the finished product of the detent escapement may be subject to the influence of accuracy variation (variations of position of the center of gravity, amplitude, timing rate, and the like). In contrast, in the present invention, since the number of the component of the detent escapement can be decreased, it is possible to improve accuracy of the finished product of the detent escapement.

The balance spring 150 configured of the spiral spring can be disposed in a window of the blade 130. The inner peripheral edge of the balance spring 150 configured of the spiral spring is fixed to a balance spring adjustment eccentric pin 151. The balance spring fixing pin 151 is disposed at a position capable of applying the force, which rotates the blade 130 in the direction in which the locking stone 132 approaches the escape wheel 110, to the blade 130. It is preferable that the balance spring 150 is disposed so as to be positioned at the side opposite to the locking stone support arm 131 and the one side actuating spring support arm 133 with respect to the rotation center 130A of the blade 130.

Figure 29:
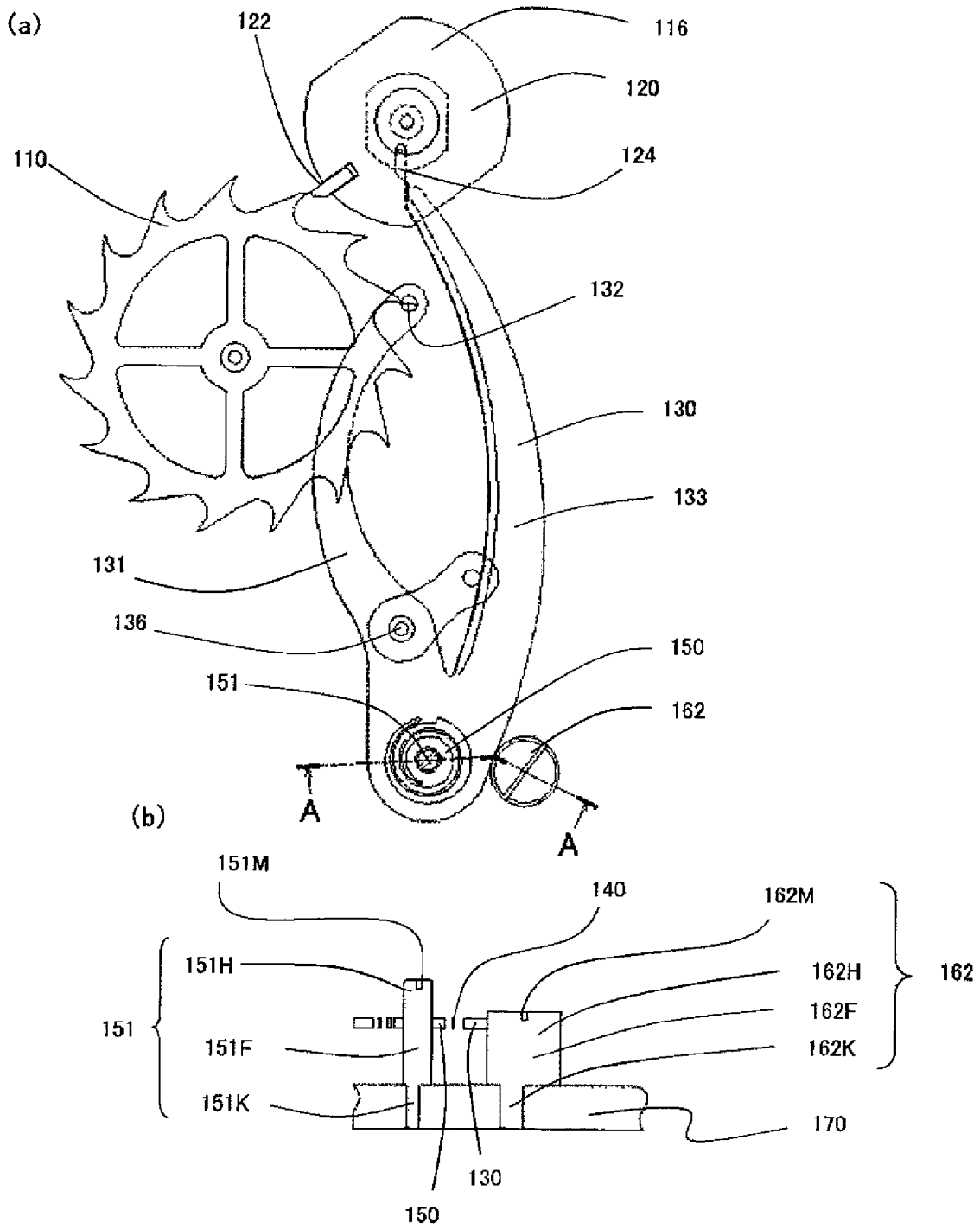
FIG. 29(*a*) is a plan diagram showing the structure of the pressurization adjustment mechanism of the blade, and FIG. 29(*b*) is a cross-sectional diagram taken along a line A-A of FIG. 29(*a*).

Referring to FIG. 29, the balance spring adjustment eccentric pin 151 for adjusting the initial position of the balance spring 150 is provided so as to be rotated with respect to the main plate 170. The balance spring adjustment eccentric pin 151 includes an eccentric shaft portion 151F, a head portion 151H, and a fixing portion 151K. The fixing portion 151K is inserted so as to be rotated in a fixing hole of the main plate 170. For example, the eccentricity of the eccentric shaft portion 151F can be set to about 0.1 mm to 2 mm. A driver groove 151M is provided in the head portion 151H. By rotating the eccentric shaft portion 151F of the balance spring adjustment eccentric pin 151, the inner end of the balance spring 150 is configured so as to move while having the center axis line of the fixing portion 151K to the reference.

Referring FIGS. 1 to 3, the balance spring 150 is configured so as to apply the force to the blade 130 in the plan which is perpendicular to the rotational center axis line 110A of the escape wheel. The one side actuating spring 140 and the balance spring 150 are disposed so as to be positioned in the symmetrical direction to the rotation center 130A of the blade 130. The direction in which the balance spring 150 applies the force to the blade 130 is configured so as to be the direction in which the portion providing the locking stone 132 of the blade 130 is rotated to the direction which approaches the escape wheel 110.

In the conventional pivoted detent escapement, it is difficult to be adjusted so as to obtain the balance of the blade by the spiral return spring due to the eccentricity according to the assembly error of the spiral return spring or influence of the eccentricity of the spiral return spring itself. Moreover, in order to correct variation of the center of gravity which is generated by the assembly error of the spiral return spring or the balance (position of the center of gravity) of the entire blade, the need for setting an adjustment type balancer is generated with consideration for the balance adjustment of the blade. Thereby, the size of the detent escapement becomes large.

Moreover, in the escapement disclosed in PTL 2, a retreat is generated twice during one reciprocation of the balance (during the time when the balance is oscillated twice in a timepiece of 1 hertz oscillation). The retreat reverses the escape wheel, which tries to rotate in the original direction, by using the inertial force of the balance, and therefore, the retreat causes the stress applied to the balance be great.

In contrast, by adopting the configuration in the present invention, since the balance spring 150 always applies the force to the blade 130, the blade 130 can be immediately returned to the initial position shown in FIG. 1. Since the force which returns the initial position in the detent escapement of the present invention corresponding to the "pulling" operation in the club tooth lever escapement is applied to the blade 130 by the balance spring 150, compared to the conventional detent escapement, the detent escapement of the present invention is characterized by less sensitivity to disturbance.

The escape wheel 110 includes an escape tooth 109 and an escape pin 111. The wheel tooth 112 is formed at the outer circumferential portion of the escape tooth 109. For example, as shown in FIG. 1, 15 wheel teeth 112 are formed in the outer circumferential portion of the escape tooth 109. The escapement wheel 110 is incorporated into the movement so as to be rotated to the main plate 170 and a train wheel bridge (not shown). The upper shaft portion of the escape pin 111 is supported so as to be rotated to the train wheel bridge (not shown). The lower shaft portion of the escape pin 111 is supported so as to be rotated to the main plate 170.

The balance 120 includes a balance staff 114, a wheel 115, a roller table 116, and a hairspring (not shown). The impulse pallet 122 is fixed to the roller table 116. The balance 120 is incorporated into the movement so as to be rotated to the main plate 170 and a balance bridge (not shown). The upper shaft portion of the balance staff 114 is supported so as to be rotated to the balance bridge (not shown). The lower shaft portion of the balance staff 114 is supported so as to be rotated to the main plate 170.

The blade 130 is incorporated into the movement so as to be rotated to the main plate 170 and the train wheel bridge (not shown). A blade shaft 136 is fixed to the rotation center 130A of the blade 130. The upper shaft portion of the blade shaft 136 is, supported so as to be rotated to the train wheel bridge (not shown). The lower shaft portion of the blade shaft 136 is supported so as to be rotated to the main plate 170. Alternatively, the blade 130 can be incorporated into the movement so as to be rotated to the main plate 170 and the blade bridge (not shown). In this configuration, the upper shaft portion of the blade shaft 136 is supported so as to be rotated to the blade bridge (not shown). A spring bearing portion 130D is provided in the tip of the one side actuating spring support arm 133 of the blade 130. The unlocking stone contact portion 140G of the one side actuating spring 140 is disposed so as to contact the spring bearing portion 130D.

Figure 30:
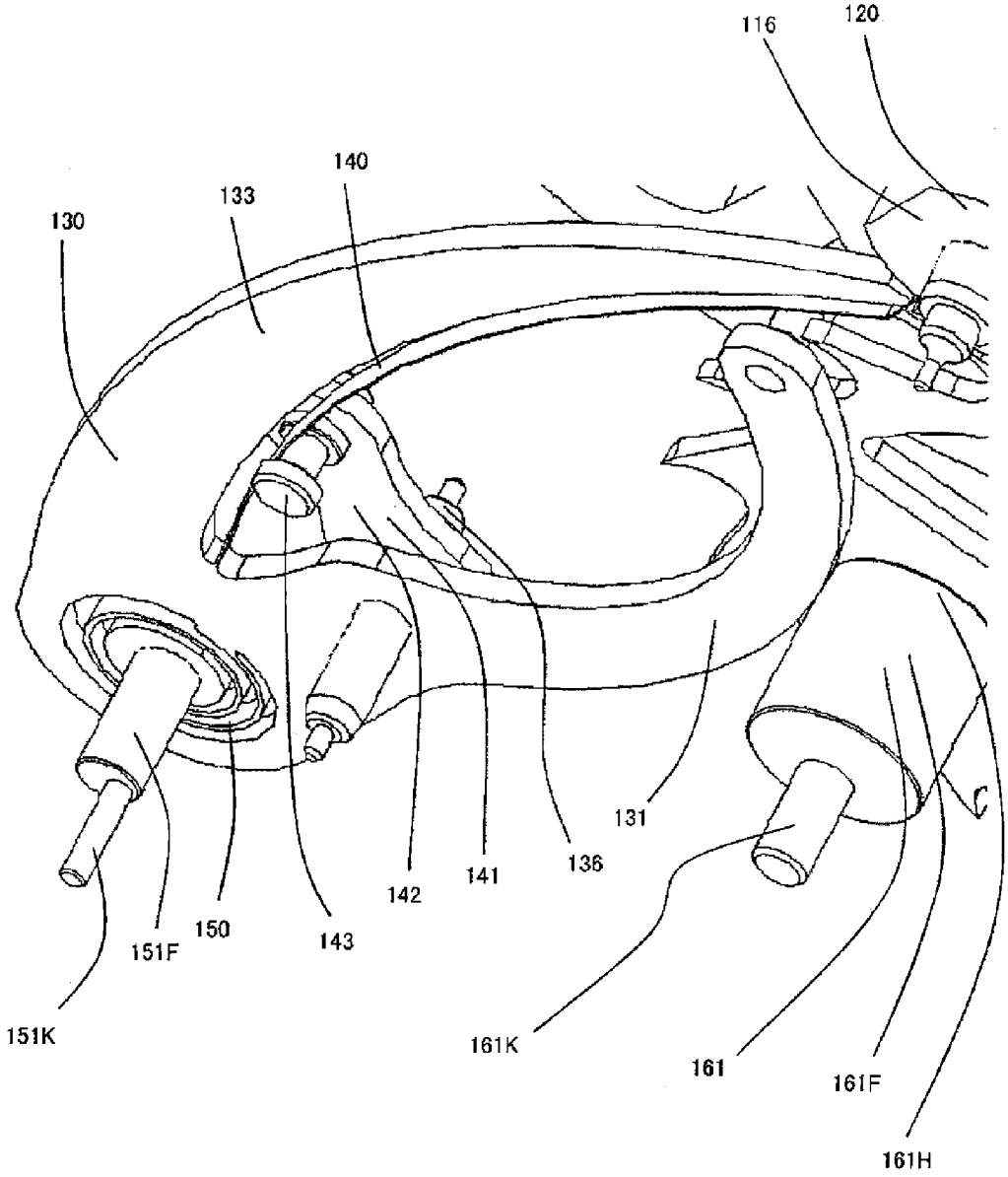
FIG. 30 is a perspective diagram showing a structure of a regulating lever and a pin of a one side actuating spring of the blade in the embodiment of the detent escapement of the present invention.

Referring to FIGS. 1 and 30, an adjustment eccentric pin 161 for adjusting the initial position of the blade 130 is provided so as to be rotated to the main plate 170. The adjustment eccentric pin 161 includes an eccentric shaft portion 161F, a head portion 161H, and a fixing portion 161K. The fixing portion 161K is inserted so as to be rotated in the fixing hole of the main plate 170. For example, the eccentricity of the eccentric shaft portion 161F can be set to about 0.1 mm to 2 mm. A driver groove 161M is provided in the head portion 161H. The eccentric shaft portion 161F of the adjustment eccentric pin 161 is disposed so as to contact the outside surface portion of the locking stone support arm 131 of the blade 130. By rotating the eccentric shaft portion 161F of the adjustment eccentric pin 161, the initial position of the blade 130 can be easily adjusted.

Referring to FIG. 29, an adjustment eccentric pin 162 for adjusting the initial position of the blade 130 can be provided so as to be rotated to the main plate 170. The adjustment eccentric pin 162 includes an eccentric shaft portion 162F, a head portion 162H, and a fixing portion 162K. The fixing portion 162K is inserted so as to be rotated in a fixing hole of the main plate 170. For example, the eccentricity of the eccentric shaft portion 162F can be set to about 0.1 mm to 2 mm. A driver groove 162M is provided in the head portion 162H. The eccentric shaft portion 162F of the adjustment eccentric pin 162 can be disposed so as to contact the side surface of the base portion of the one side actuating spring support arm 133 of the blade 130. By rotating the eccentric shaft portion 162F of the adjustment eccentric pin 162, the initial position of the blade 130 can be easily adjusted.

Referring to FIGS. 1, 3, and 29, a one side actuating spring regulating lever 141 for pressing the unlocking stone contact portion 140G of the one side actuating spring 140 to the one side actuating spring support arm 133 is provided in the blade 130. The one side actuating spring regulating lever 141 includes a regulating lever body 142 and a regulating pin 143. The regulating lever body 142 can be fixed to the blade shaft 136. The regulating pin 143 is fixed to the regulating lever body 142. The side surface portion of the regulating pin 143 is configured so as to contact the side surface portion of the portion close to the supporting point of the one side actuating spring 140 in order to press the unlocking stone contact portion 140G of the one side actuating spring 140 to the one side actuating spring supporting arm 133.

Referring to FIG. 1, as a modification, the regulating lever body 142B (indicated by a virtual line) can be fixed to the blade 130 in a position which is different from the position of the blade shaft 136. The regulating lever body 142 can be fixed by a flanged pin or the like, or can be fixed by as a set screw. According to this configuration, the force pressing the one side actuating spring 140 can be easily adjusted by the one side actuating spring regulating lever 141.

(2) Configuration of Blade (2-1) First Type

As described above, referring to FIG. 3, a main body portion 130H of a first type blade 130 includes the locking stone support arm 131, the one side actuating spring 140, a one side actuating spring support arm 133, and the balance spring 150. The one side actuating spring 140 and the balance spring 150 are integrally formed with the blade 130. The unlocking stone contact portion 140G of the one side actuating spring 140 is configured so that the angle DG with respect to the working reference line 129 which is the line connecting the rotation center 120A of the balance 120 and the rotation center 130 of the blade 130 is a range of 5° to 45°. The lower surface (that is, the surface of the main plate side) of the one side actuating spring supporting arm 133 and the lower surface (that is, the surface of the main plate side) of the one side actuating spring 140 are configured so as to be positioned in one plane. The one side actuating spring 140 is disposed at the position which is closer to the working reference line 129 than the one side actuating spring support arm 133.

The locking stone arm 131 is formed in a shape which includes one or more curved portions so as to be convex when viewed from the working reference line 129. The one side actuating spring support arm 133 is formed in a shape which includes one or more curved portion so as to be convex when viewed from the working reference line 129. That is, the locking stone support arm is configured so as to be curved to the side opposite to the one side actuating spring support arm. The one side actuating spring 140 is formed in a shape which includes one or more curved portion so as to be convex when viewed from the working reference line 129.

The outer peripheral edge of the balance spring 150 which is configured by a spiral spring is fixed to the blade 130. The balance spring 150 is formed in the window which is provided on a portion in which the base portion of the locking stone support arm 131 and the base portion of the one side actuating spring support arm 133 are integrated to each other. That is, the balance spring is disposed so as to be positioned at the side opposite to the locking stone support arm and the one side actuating spring support arm with respect to the rotation center of the blade.

It is preferable that the blade 130 is formed so that the thickness of the locking stone support arm 131, the thickness of the one side actuating spring 140, the thickness of the one side actuating spring support arm 133, and the thickness of the balance spring 150 are the same as one another. It is preferable that the blade 130 is formed so that the material of configuring the locking stone support arm 131, the material of configuring the one side actuating spring 140, the material of configuring the one side actuating spring support arm 133, and the material of configuring the balance spring 150 are the same as one another.

In the conventional detent escapement, due to the fact that the position of the center of gravity of the blade is not present at the supporting point of the blade, an increase in the moment of inertia of the blade is generated, and there is an issue (problem) in that the return to the original position of the spiral return spring is delayed. In addition, due to the fact that the position of the center of gravity of the blade is not present at the supporting point of the blade, when the detent escapement has the vertical posture, the detent escapement receives the influence of the gravity, and the difference in the release of the blade and the operation of the original position return of the spiral return spring is generated due to the posture difference. Thereby, particularly, the difference in the escapement error is generated when the escapement has the vertical posture, and there is a problem in that the timing rate difference (posture difference) is great.

In contrast, in the present invention, by adopting the above-described configuration, the position of the center of gravity of the blade 130 can be close to the supporting point of the blade 130, and the moment of inertia of the blade 130 can be decreased.

In addition, it is preferable that the one side actuating spring supporting arm 133 is configured at an angle so that the distance of the tip of the one side actuating spring supporting arm from the working reference line is increased as the tip is separated from the rotation center of the balance in the side opposite to the side at which the escape wheel 110 is present with respect to the working reference line. In addition, the entire shape of the one side actuating spring support arm 133 may be formed in any one. However, as described above, it is preferable that the one side actuating spring support arm has curved portions. Due to the fact that the one side actuating spring support arm 133 includes the curved portions, the interference between the one side actuating spring support arm 133 and the locking stone support arm 131 can be reliably avoided, the distance from the tip of the one side actuating spring support arm 133 to the supporting point of the one side actuating spring can be minimized, and the moment of inertia of the blade 130 can be decreased.

In addition, it is preferable that the one side actuating spring support arm 133 is configured so that the cross-sectional area thereof is increased from the tip toward the base portion. Thereby, since the tip of the one side actuating spring support arm 133 is tapered and the weight of the tip is smaller compared to the base portion, the moment of inertia of the one side actuating spring support arm 133 can be decreased. In addition, even though stress is concentrated in the base portion of the one side actuating spring support arm 133, since the base portion of the one side actuating spring support arm 133 is formed so as to be thicker than the tip thereof, it is possible to prevent the base portion of the one side actuating spring support arm from being damaged.

(2-2) Second Type

Figure 4:
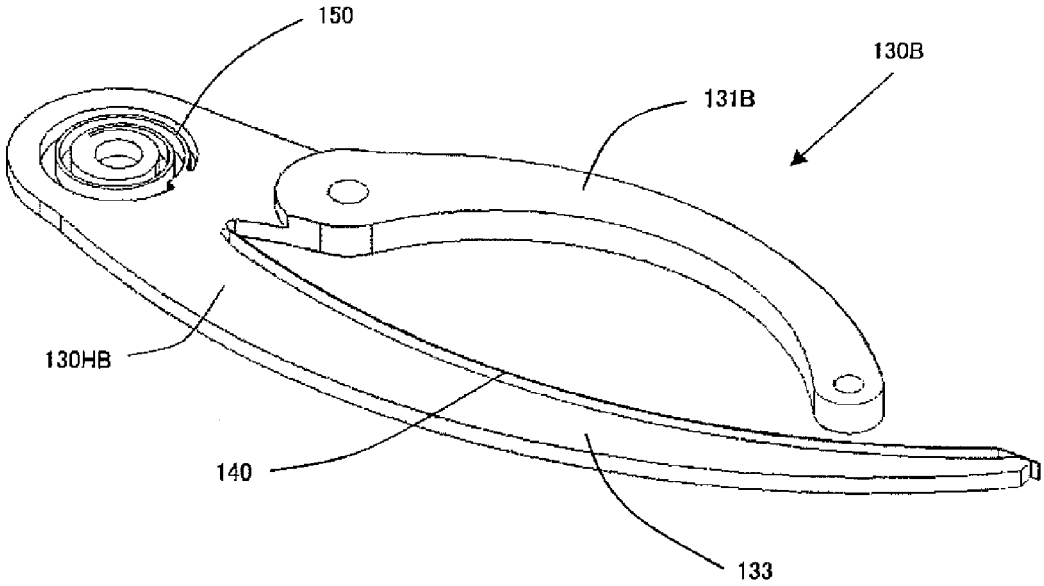
FIG. 4 is a perspective diagram showing a second structure of a blade in the embodiment of the detent escapement of the present invention.

Referring to FIG. 4, a main body 130 HB of a second type blade 130B includes a locking stone support arm 131B, the one side actuating spring 140, the one side actuating spring support arm 133, and the balance spring 150. The thickness of the locking stone support arm 131B is configured so as to be thicker than the thickness of the one side actuating spring 140. In the second type blade 130B, other configurations are the same as those of the above-described first type blade 130. According to this configuration, the position of the center of gravity of the blade can be disposed on the working reference line 129, or the position of the center of gravity of the blade can be disposed so as to close to the working reference line 129.

(2-3) Third Type

Figure 5:
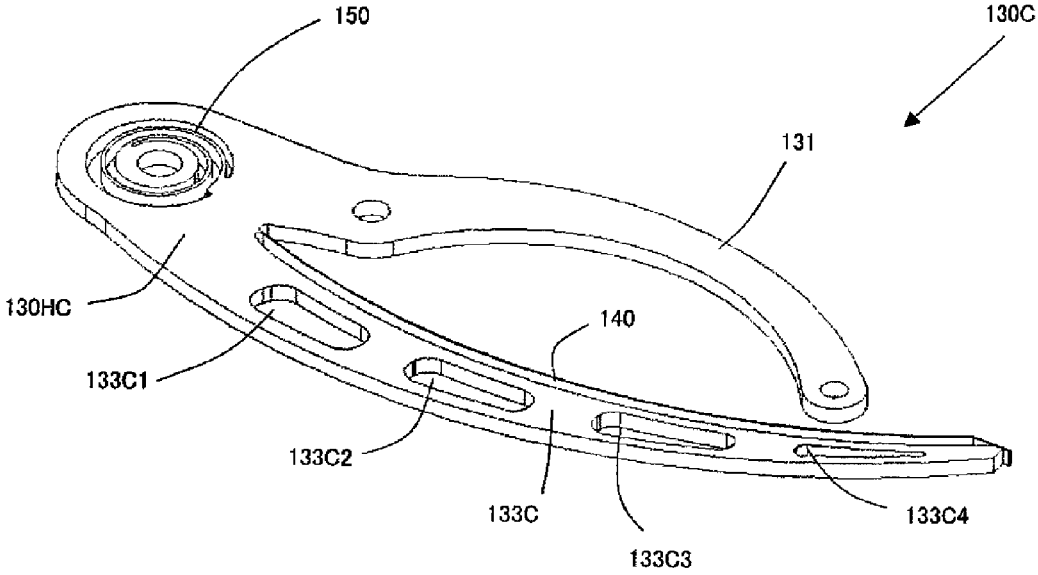
FIG. 5 is a perspective diagram showing a third structure of the blade in the embodiment of the detent escapement of the present invention.

Referring to FIG. 5, a main body portion 130HC of a third type blade 130C includes the locking stone support arm 131, the one side actuating spring 140, a one side actuating spring support arm 133C, and the balance spring 150. A portion of the one side actuating spring support arm 133C has material removed. In the shown example, four material-removed portions 133C1 to 133C4 are provided in the one side actuating spring support arm 133C. The number of the material-removed portions which is provided in the one side actuating spring support arm 133C may be one or a plurality. In the third type blade 130C, other configurations are the same as those of the above-described first type blade 130. According to this configuration, the position of the center of gravity of the blade can be disposed on the working reference line 129, or the position of the center of gravity of the blade can be disposed so as to close to the working reference line 129. According to the configuration, weight-saving of the blade can be realized, and the moment of inertia of the blade can be decreased.

(2-4) Fourth Type

Figure 6:
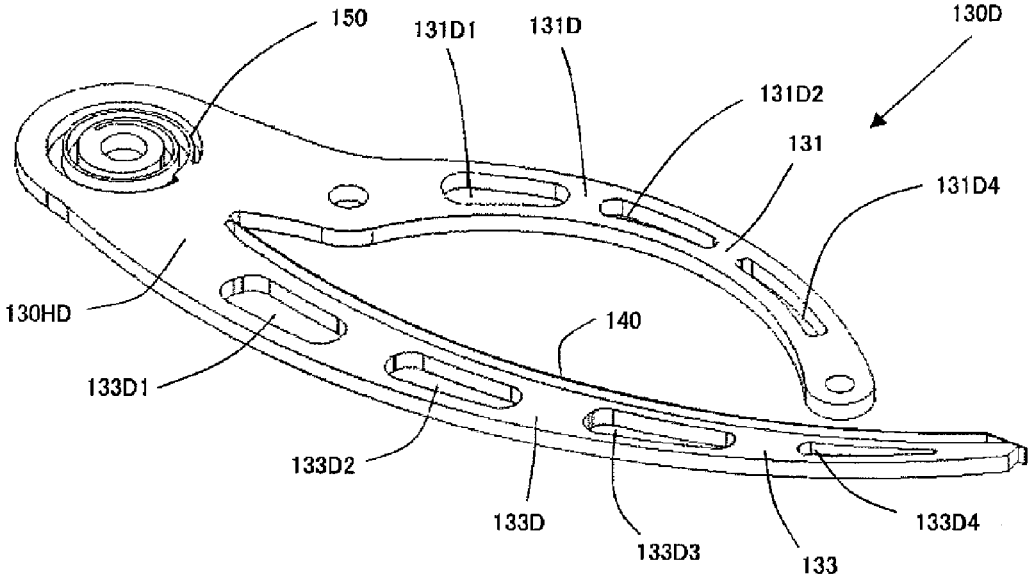
FIG. 6 is a perspective diagram showing a fourth structure of the blade in the embodiment of the detent escapement of the present invention.

Referring to FIG. 6, a main body portion 130HD of a fourth type blade 130D includes a locking stone support arm 131D, the one side actuating spring 140, a one side actuating spring support arm 133D, and the balance spring 150. A portion of the locking stone support arm 131D is material-removed, and a portion of the one side actuating spring support arm 133D is material-removed. In the shown example, the material-removed portion 131D1 to 131D3 of three places are provided on the locking stone support arm 131B, and the material-removed portions 133D1 to 133D4 of four places are provided on the one side actuating spring support arm 133D. The number of the material-removed portions which is provided in the locking stone support arm 131B may be one or a plurality. The number of the material-removed portions which is provided in the one side actuating spring support arm 133D may be one or a plurality. In the fourth type blade 130D, other configurations are the same as those of the above-described first type blade 130. By selecting the number of the provided material-removed portions and the position in which the material-removed portion is provided, the position of the center of gravity of the blade can be disposed on the working reference line 129, or the position of the center of gravity of the blade can be disposed so as to close to the working reference line 129. According to the configuration, weight-saving of the blade can be realized, and the moment of inertia of the blade can be decreased. As described above, in the preferable structure of the detent escapement of the present invention, at least one side of a portion of the locking stone support arm and a portion of the one side actuating spring support arm can be configured so as to have material removed.

(2-5) Fifth Type

Figure 7:
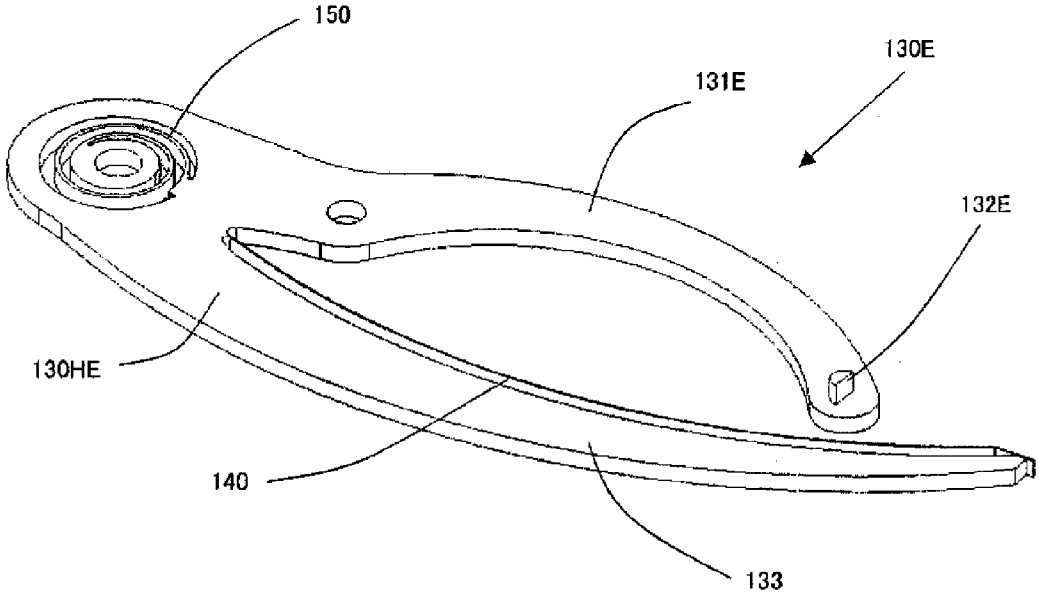
FIG. 7 is a perspective diagram showing a fifth structure of the blade in the embodiment of the detent escapement of the present invention.

Referring to FIG. 7, a main body portion 130HE of the fifth type blade 130E includes a locking stone support arm 131E, the one side actuating spring 140, the one side actuating spring support arm 133, and the balance spring 150. A locking stone 132E is integrally formed with the locking stone support arm 131E. According to this configuration, the manufacturing processes of the blade and the locking stone can be decreased.

(2-6) Sixth Type

Figure 8:
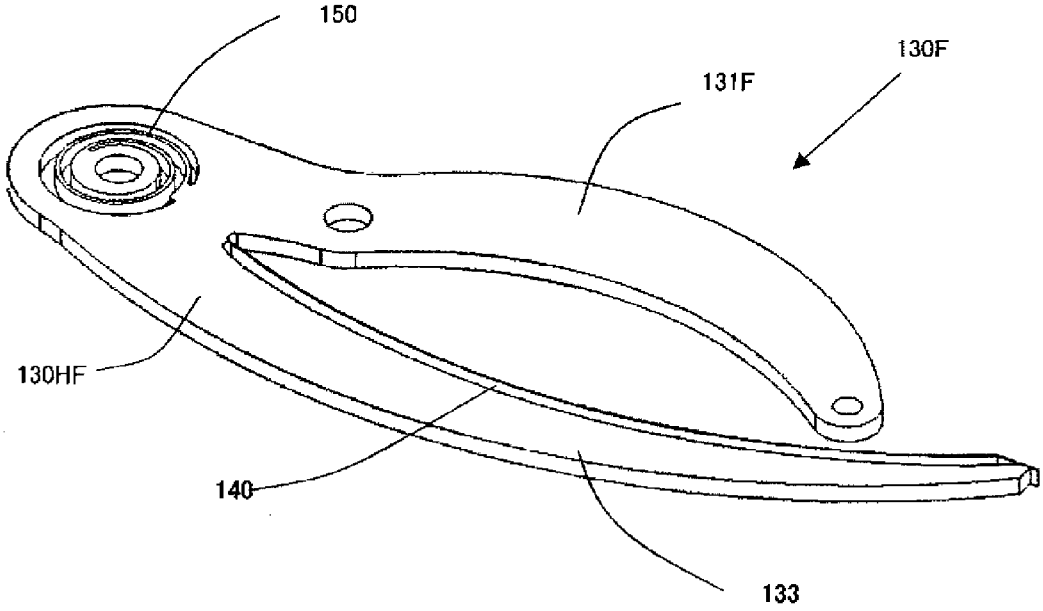
FIG. 8 is a perspective diagram showing a sixth structure of the blade in the embodiment of the detent escapement of the present invention.

Referring to FIG. 8, a main body portion 130HF of a sixth type blade 130F includes a locking stone support arm 131F, the one side actuating spring 140, the one side actuating spring support arm 133, and the balance spring 150. The width of the locking stone support arm 131F is configured so as to be wider than the width of the one side actuating spring 140. In the sixth type blade 130F, other configurations are the same as those of the above-described first type blade 130. According to this configuration, the position of the center of gravity of the blade can be disposed on the working reference line 129, or the position of the center of gravity of the blade can be disposed so as to close to the working reference line 129.

(2-7) Seventh Type

Figure 9:
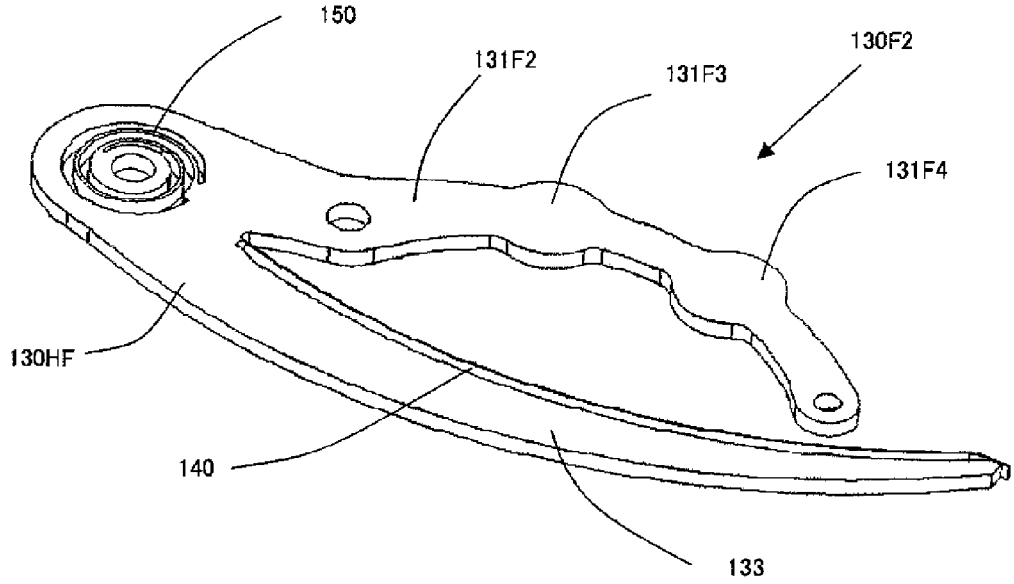
FIG. 9 is a perspective diagram showing a seventh structure of the blade in the embodiment of the detent escapement of the present invention.

Referring to FIG. 9, a main body portion 130HF of a seventh type blade 130F2 includes a locking stone support arm 131F2, the one side actuating spring 140, the one side actuating spring support arm 133, and the balance spring 150. Two wide portions 131F3 and 131F4 are formed in the locking stone support arm 131F2. The widths of the wide portions 131F3 and 131F4 are configured so as to be wider than the width of the one side actuating spring 140. The number of the provided wide portions may be one or a plurality. In the seventh type blade 130F2, other configurations are the same as those of the above-described first type blade 130. According to this configuration, the position of the center of gravity of the blade can be disposed on the working reference line 129, or the position of the center of gravity of the blade can be disposed so as to close to the working reference line 129.

(2-8) Eighth Type

Figure 10:
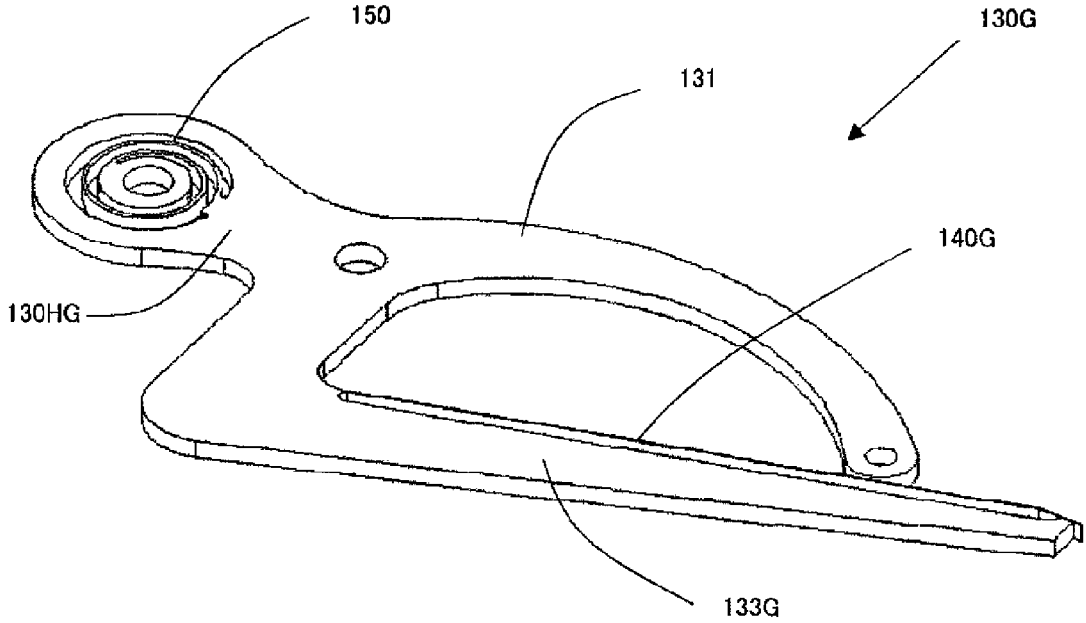
FIG. 10 is a perspective diagram showing an eighth structure of the blade in the embodiment of the detent escapement of the present invention.

Referring to FIG. 10, a main body portion 130HG of an eighth type blade 130G includes the locking stone support arm 131, the one side actuating spring 140G, a one side actuating spring support arm 133G, and the balance spring 150. The one side actuating spring 140G is configured so as to be a line shape. The one side actuating spring support arm 133G is configured so as to be a line shape. In the eighth type blade 130G, other configurations are the same as those of the above-described first type blade 130. According to this configuration, a deflection characteristic of the one side actuating spring 140G can be stabilized.

(2-9) Ninth Type

Referring to FIG. 11, a main body portion 130 HJ of the blade 130J of a ninth type includes the locking stone support arm 131G and the one side actuating spring support arm 133G. The one end of the one side actuating spring 140G, which is separately formed from the main body portion 130HJ, is fixed into a slit of the main body portion 130HJ by a welding processing such as laser welding. The one outer end of the balance spring 150J which is separately formed from the main body portion 130HJ is fixed onto the upper surface of the main body portion 130HJ by a welding processing such as laser welding. In the ninth type blade 130G, other configurations are the same as those of the above-described first type blade 130. According to this configuration, the one side actuating spring 140G can be formed of a material having a better deflection characteristic than the deflection characteristic of the material which forms the main body portion 130HJ. In addition, according to this configuration, the balance spring 150J can be formed of a material having a better deflection characteristic than the deflection characteristic of the material which forms the main body portion 130HJ.

(2-10) Tenth Type

Figure 12:
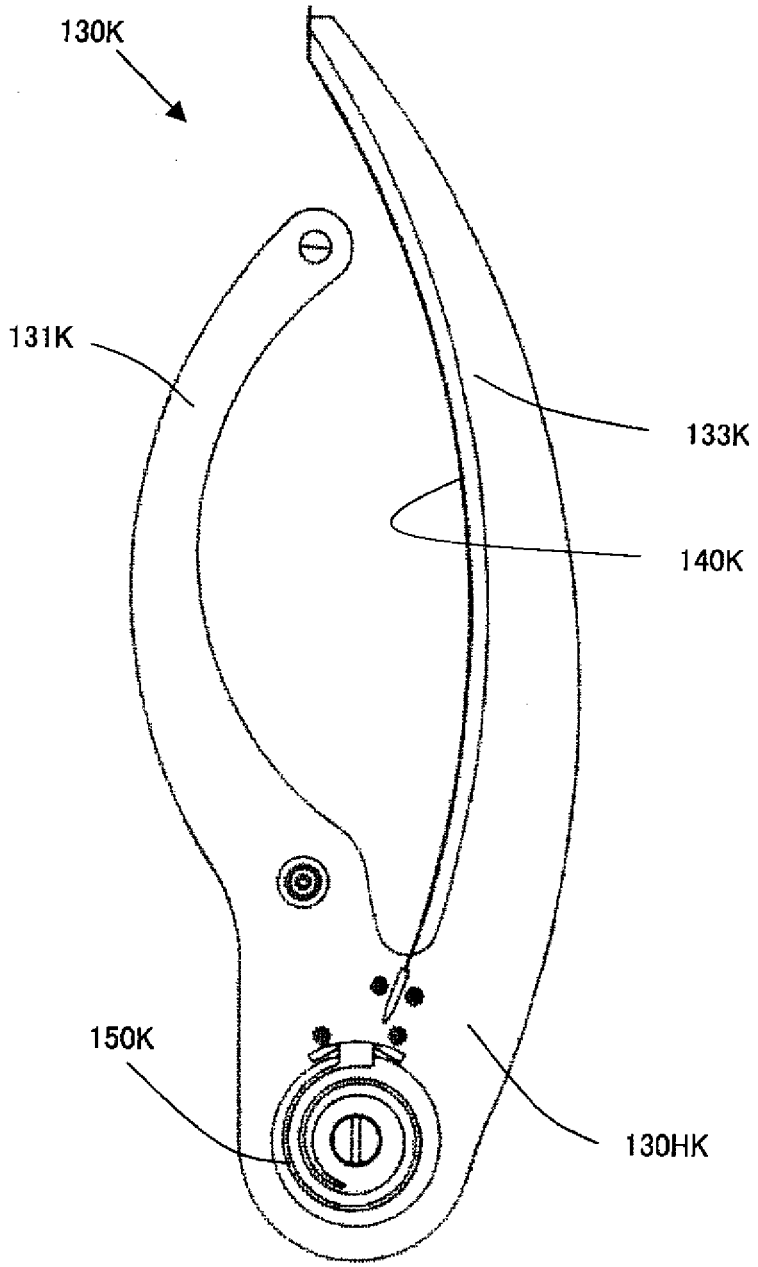
FIG. 12 is a plan diagram showing a tenth structure of the blade in the embodiment of the detent escapement of the present invention.

Referring to FIG. 12, a main body portion 130HK of a blade 130K of a tenth type includes a locking stone support arm 131K and the one side actuating spring support arm 133K. The one end of the one side actuating spring 140K, which is separately formed from the main body portion 130HK, is fixed into a slit of the main body portion 130HK by a caulking processing. The one outer end of the balance spring 150K which is separately formed from the main body portion 130HK is fixed into a slit of the main body portion 130HK by a caulking processing. In the tenth type blade 130K, other configurations are the same as those of the above-described first type blade 130. According to this configuration, the one side actuating spring 140K can be formed of a material having a better deflection characteristic than the deflection characteristic of the material which forms the main body portion 130HK. In addition, according to this configuration, the balance spring 150K can be formed of a material having a better deflection characteristic than the deflection characteristic of the material which forms the main body portion 130HK.

(2-11) Eleventh Type

Figure 13:
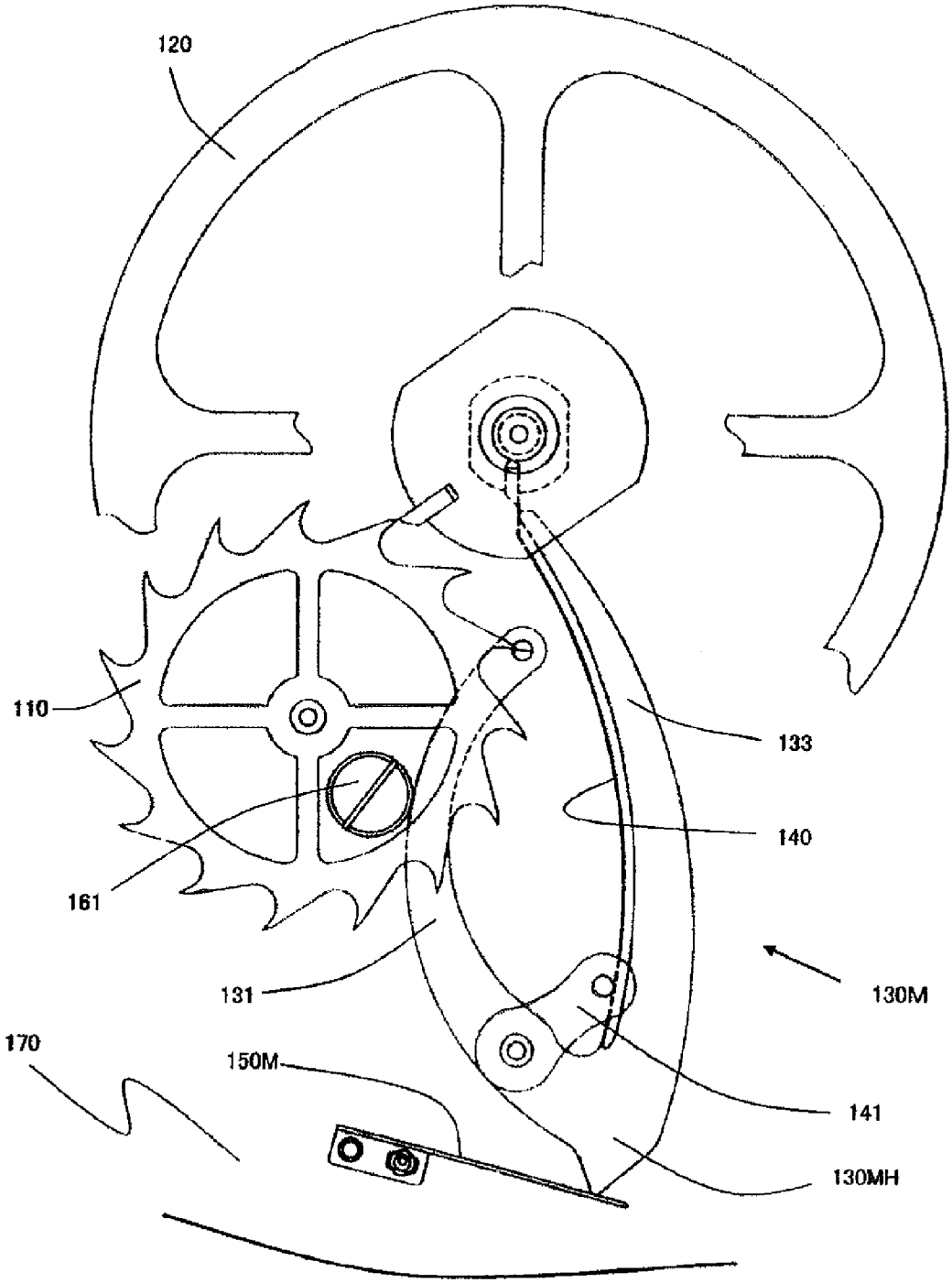
FIG. 13 is a plan diagram showing an eleventh structure of the blade and a structure of a balance spring including a pressurization adjustment mechanism in the embodiment of the detent escapement of the present invention.

Referring to FIG. 13, a main body portion 130HM of a blade 130M of an eleventh type includes the locking stone support arm 131, the one side actuating spring support arm 133, and the one side actuating spring 140. The vicinity of the tip of the deforming spring portion of the balance spring 150M which is separately formed with the main body portion 130HM is disposed so as to press to the main body portion 130HM. The balance spring 150M is fixed to the main plate 170. In the eleventh type blade 130M, other configurations are the same as those of the above-described first type blade 130. According to this configuration, the one side actuating spring 150K can be formed of a material having a better deflection characteristic than the deflection characteristic of the material which forms the main body portion 130HK.

(2-12) Twelfth Type

Referring to FIG. 14, a blade 130N of a twelfth type includes a main body portion 130HN, the locking stone support arm 131, and a one side actuating spring support arm 133N. The one side actuating spring support arm 133N is separately formed from the main body portion 130HN and the locking stone support arm 131. The one end of the one side actuating spring 140N which is separately formed from the main body portion 130HN is disposed between the main body portion 130HN and the one side actuating spring support arm 133N, and is fixed to the main body portion 130HN and the one side actuating spring support arm 133N by two horizontal screws 145N1 and 145N2. The vicinity of the tip of the deforming spring portion of the balance spring 150N which is separately formed with the main body portion 130HN is disposed so as to press to the main body portion 130HN. The balance spring 150N is fixed to the main plate 170. In the twelfth type blade 130N, other configurations are the same as those of the above-described first type blade 130. According to this configuration, the one side actuating spring 140N can be formed of a material having a better deflection characteristic than the deflection characteristic of a material which forms the main body portion 130HN. In addition, according to this configuration, the balance spring 150N can be formed of a material having a better deflection characteristic than the deflection characteristic of a material which forms the main body portion 130HN.

(2-13) Thirteenth Type

Figure 15:
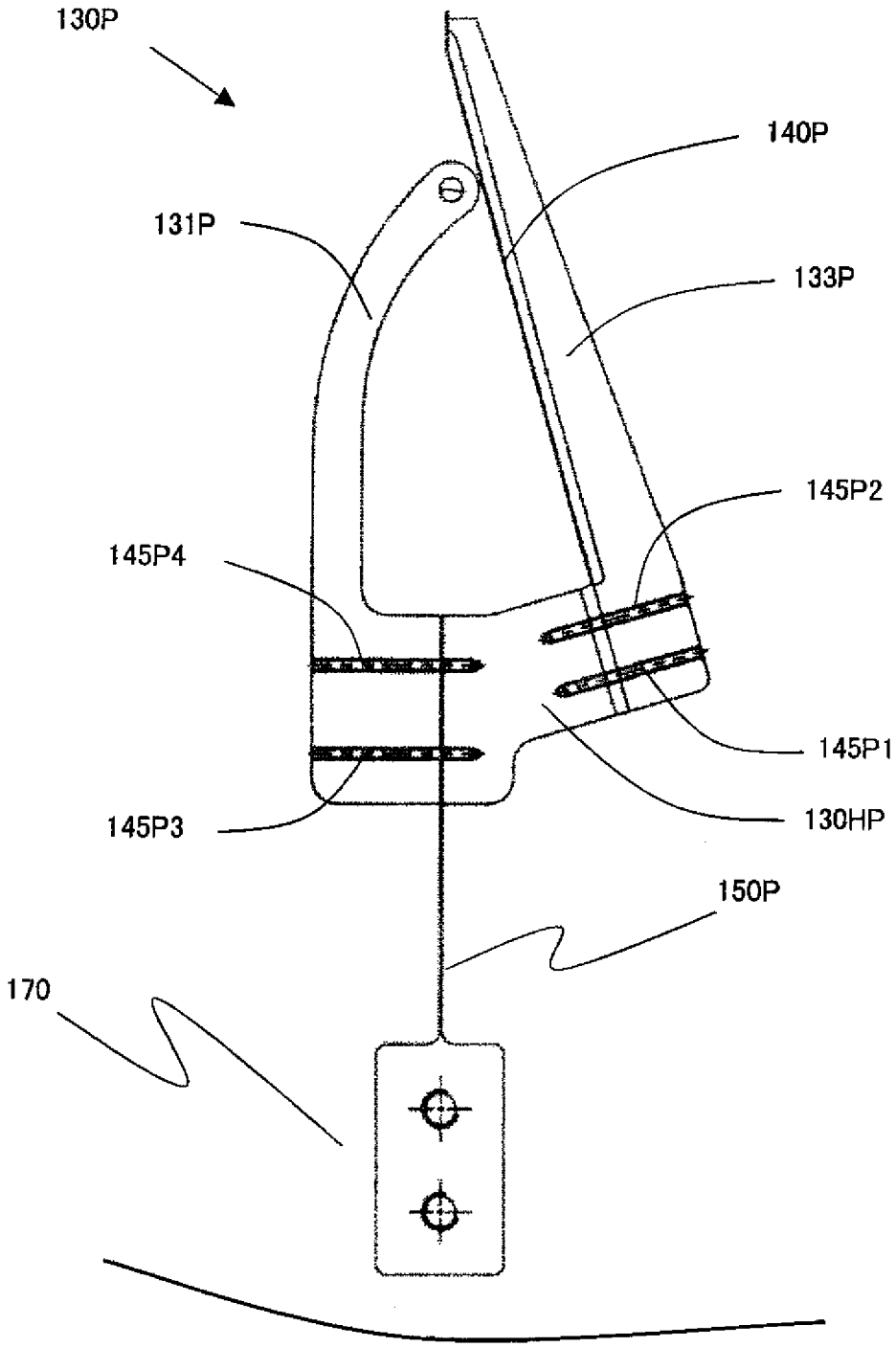
FIG. 15 is a plan diagram showing a thirteenth structure of the blade in the embodiment of the detent escapement of the present invention.
Figure 16A:
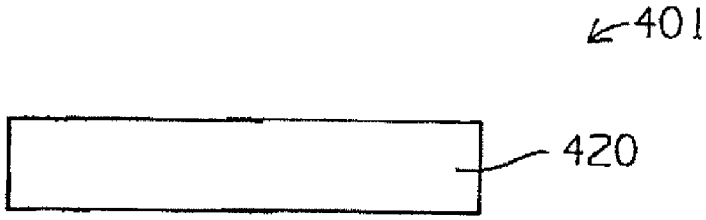
FIGS. 16(*a*)-16(*e*) are diagrams illustrating a portion of manufacturing processes of the blade in the embodiment of the detent escapement of the present invention.
Figure 16B:
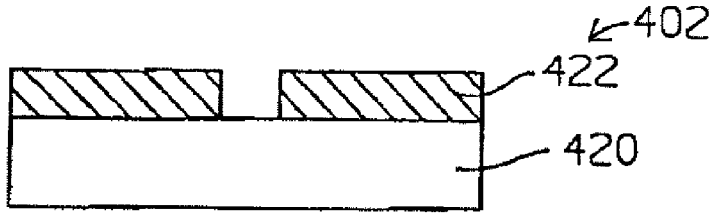
Figure 16C:
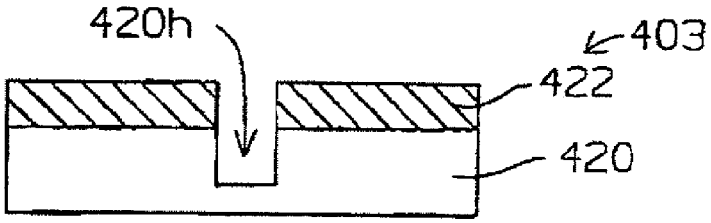
Figure 16D:
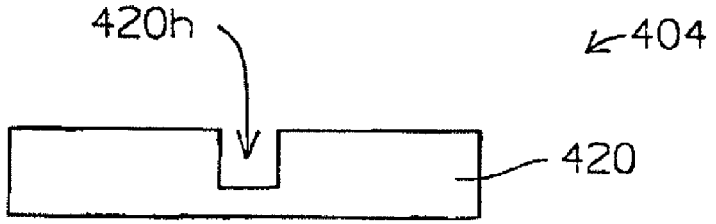
Figure 16E:
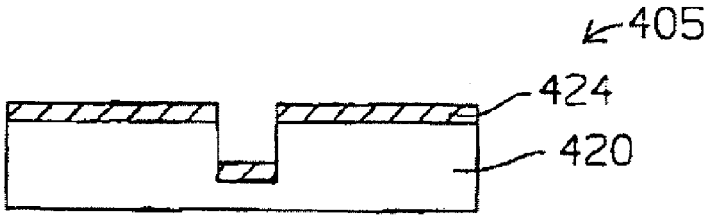
Figure 17A:
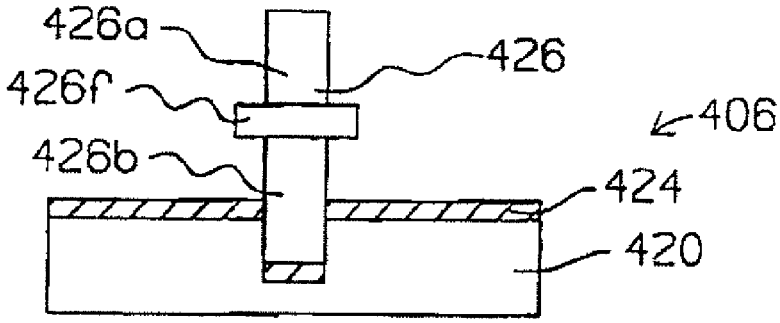
FIGS. 17(*a*)-17(*d*) are diagrams illustrating a portion of the manufacturing processes of the blade in the embodiment of the detent escapement of the present invention.
Figure 17B:
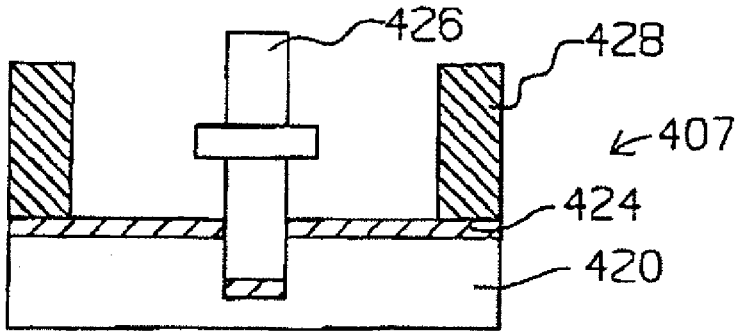
Figure 17C:
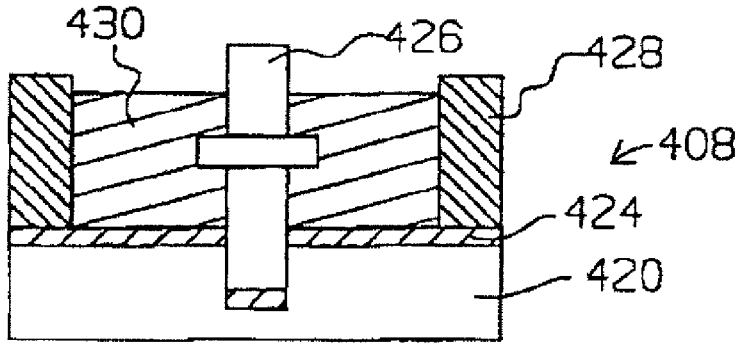
Figure 17D:
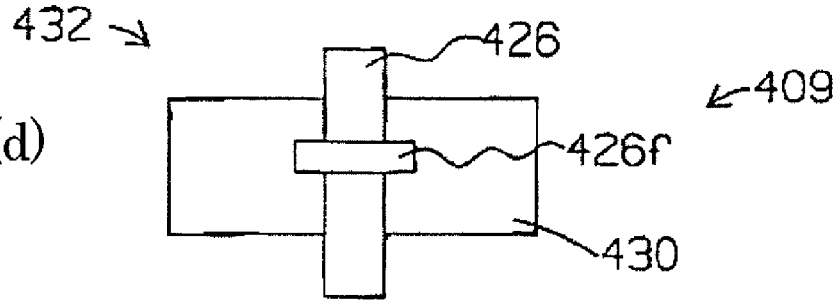

Referring to FIG. 15, a blade 130P of a thirteenth type includes a main body portion 130HP, a locking stone support arm 131P, and a one side actuating spring support arm 133P. The locking stone support arm 131P is separately formed from the main body portion 130HP. The one side actuating spring support arm 133N is separately formed from the main body portion 130HP. The one end of the one side actuating spring 140P which is separately formed from the main body portion 130HN is disposed between the main body portion 130HP and the one side actuating spring support arm 133P, and is fixed to the main body portion 130HP and the one side actuating spring support arm 133P by two horizontal screws 145P1 and 145P2. The vicinity of the tip of the deforming spring portion of the balance spring 150N which is separately formed from the main body portion 130HN is disposed between the main body portion 130HP and the locking stone support arm 131P, and is fixed to the main body portion 130H2 and the locking stone support arm 131P by two horizontal screws 145P3 and 145P4. The base portion of the deforming spring portion of the balance spring 150P is fixed to the main plate 170. In the thirteenth type blade 130P, other configurations are the same as those of the above-described first type blade 130. According to this configuration, the one side actuating spring 1402 can be formed of a material having a better deflection characteristic than the deflection characteristic of the material which forms the main body portion 130HP. According to this configuration, the balance spring 150P can be formed of a material having a better deflection characteristic than the deflection characteristic of the material which forms the main body portion 130HP.

(3) Method of Manufacturing Blade

Next, an example of a method of manufacturing the blade will be described.

(3-1) First Manufacturing Process for Blade

Referring FIG. 16(*a*), a substrate 420 which is used for manufacturing an electroforming component is prepared (process 401). The material configuring the substrate 420 includes silicon, glass, plastic, or the like. Considering the process accuracy of the etching, the silicon is preferable. For example, it is preferable that size of the substrate 420 is a standard size which is used in a semiconductor manufacturing of a range of 2 inch (about 50 mm) to 8 inch (about 200 mm). Although the thickness of the substrate 420 is different according to the size of the substrate 420, for example, the thickness of the substrate 420 is 300 μm to 625 μm at the case of the silicon substrate of 4 inch.

Referring FIG. 16(*b*), a photoresist is coated on the surface of the substrate 420, necessary shapes are exposed on the coated photoresist, and the developed mask 422 is patterned (process 402). The mask 422 may be formed of other oxide films such as the photoresist or $SiO_2$ and a metal film such as aluminum or chromium. When the mask, which is configured of a material other than the photoresist, is used, mask can be formed by etching the material other than the photoresist while having the photoresist as the mask. The thickness of the mask 422 is determined by a selecting ratio and an etching depth at the time of etching of the substrate 420 and the mask 422. For example, when the selection ratio of the substrate 420 and the mask 422 is 100 to 1, the thickness of the mask 422 which is necessary with respect to the etching depth of 100 μm of the substrate 420 is 1 μm or more. Preferably, the thickness of the mask is a range of 1.5 μm to 10 μm.

Referring to FIG. 16(*c*), the substrate 420 having the mask 422 is etched by a DRIE (Deep RIE), and an etching hole 420*h* is formed on the substrate 420 (process 403).

Referring FIG. 16(*d*), the mask 422 is removed from the surface of the substrate 420 (process 404). Alternatively, the mask 422 is not removed, and a metallic thin film is formed on the mask 422 and a surface conducting for the electroforming process is performed. For example, the metallic thin film which is formed on the mask 422 can be configured of gold, silver, copper, nickel, or the like. In this method, by selecting the material which configures the mask 422, it is also possible to use the mask as a sacrificing layer when the electroforming component is removed from the surface of the substrate 420. As the material which can be used as the sacrificing layer, for example, there is a resin material which is represented by the photoresist. The photoresist can be easily removed by an organic solvent, a fuming nitric acid, or the like.

Referring to FIG. 16(*e*), a conducting film 424 of metals such as gold, silver, copper, or nickel is deposited on the surface of the substrate 420 and the bottom surface of the etching hole 420*h*, and the conducting of the surface of the substrate 420 is performed (process 405). The deposition of the metal conducting film 424 can be performed by a method such as sputtering, vapor deposition, or electroless plating. It is preferable that the thickness of the metal conducting film 424 is a range of several nm (discontinuous film) to several μm.

Referring to FIG. 17(*a*), a shaft component 426 is prepared. In the blade of the present invention, the shaft component is the blade shaft 136 and the balance spring adjustment eccentric pin 151. The material which configures the shaft component 426 may use a non-conducting material such as glass, ceramic, or plastic. When the shaft component 426 is configured by aluminum, it is preferable that alumite treatment is performed to the shaft component 426. When the shaft component 426 is configured by a metal such as carbon steel or a stainless steel, it is preferable that an oxide film is added to the shaft component 426. As the oxide film which is added, there is an anodic oxide film or SiO2 of the metal which configures the shaft component 426. Alternatively, when the shaft component 426 is configured of a metal, a synthetic resin such as Teflon (registered trademark) may be coated on the shaft component 426. As the material which is coated, in addition to Teflon (registered trademark), there are non-conducting resins such as acrylic resin, epoxy resin, polycarbonate, or polyimide. Alternatively, when the shaft component 426 is configured of a metal, the resist is deposited on a portion in which the electroforming metal of the shaft component 426 is not precipitated, and the resist may be peeled after the electroforming process ends.

The shaft component 426 includes an upper shaft portion 426*a*, a lower shaft portion 426*b*, and a flange 426*f* which is positioned between the upper shaft portion 426*a* and the lower shaft portion 426*b*. A portion of the lower shaft portion which includes the tip of the lower shaft portion 426*b* of the shaft component 426 is inserted into the etching hole 420*h* of the substrate 420 (process 406). In this state, the lower surface of the flange 426*f* of the shaft component 426 may be disposed so as to be separated from the conducting film 424. The inner diameter of the etching hole 420*h* is determined so as to receive the lower shaft portion 426*b*. According to the method of the present invention, the operation can be easily performed compared to the case where the shaft component 426 is inserted into the main body component which is divided into pieces. Moreover, in the method of the present invention, since the position of the etching hole 420*h* of the substrate 420 into which the lower shaft portion 426*b* of the shaft component 426 is to be inserted is determined in advance, it is possible to automate the process which inserts the shaft component 426. In addition, in the method of the present invention, for example, since the shaft component 426 is inserted into a large wafer having an outer diameter of 4 inch (about 100 mm) to 8 inch (about 200 mm), the mechanical strength of the component into which the shaft component 426 is to be inserted is great, and there is no concern that the portion may be damaged.

Referring to FIG. 17(*b*), the resist having a thick film is deposited on the substrate 420, the deposited thick-film resist is exposed to the required shape and is developed, and the resist 428 for forming the external shape is patterned (process 407). The thickness of the resist 428 for forming the external shape is set so as to be thicker than the thickness of the main body of the component which is to be processed by the electroforming. It is preferable that the thickness of the resist 428 for forming the external shape is formed so as to be thicker than the upper surface of the flange 426*f* of the shaft component 426. Although the thickness of the resist 428 for forming the external shape is different according to the thickness of the main body of the component which is to be processed by the electroforming, it is preferable that the thickness of the resist is a range of 100 μm to several mm. In the method of the present invention, the process 407 may be performed after the process 406 is performed. Alternatively, by reversing the order of the above processes, the process 406 may be performed after the process 407 is performed.

Referring to FIG. 17(*c*), the electroforming processing of the substrate 420 into which the shaft component 426 is inserted is performed, and an electroforming metal portion 430 is formed between the resist 428 for forming the external shape and the shaft component 426 (process 408).

When a mechanical component is formed, for example, the electroforming metal which forms the electroforming metal portion 430 may be configured of chromium, nickel, steel, and alloys containing these, which have a high hardness, considering sliding at the case of using structures such as a lever. In addition, the electroforming metal portion 430 may be configured of two or more kinds metals or alloys having different characteristics in which the inner surface of the structure is configured of chromium, nickel, steel, and alloys containing these, which have a high hardness, and the outer surface of the structure is configured of tin, zinc, and alloys containing these, which have a low hardness. Moreover, in the electroforming metal portion 430, the outer surface and the inner surface of the structure may be configured of alloys or the like which have a different metal composition.

It is preferable that the flange 426*f* of the shaft component 426 is disposed in the electroforming metal portion 430. By disposing the flange 426*f* in the electroforming metal portion 430, the contact area between the shaft component 426 and the electroforming metal portion 430 can be increased, the shaft component 426 can be suppressed from falling out of the electroforming metal portion 430, and the shaft component 426 can be effectively suppressed from being rotated to the electroforming metal portion 430. That is, the flange 426*f* is configured so as to be positioned in the electroforming metal portion 430 which is integrally formed with the shaft component 426, and is configured so as to have a shape profile which inhibits the falling out of the shaft component 426, the rotating of the shaft component 426, or the like.

Figure 18A:
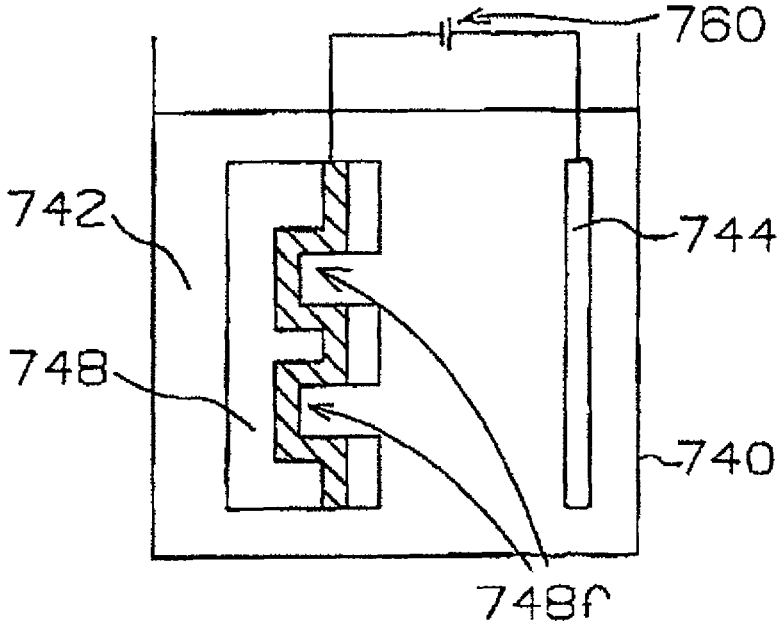
FIGS. 18(*a*)-18(*b*) are diagrams illustrating an outline of an electroforming process of manufacturing the blade in the embodiment of the detent escapement of the present invention.
Figure 18B:
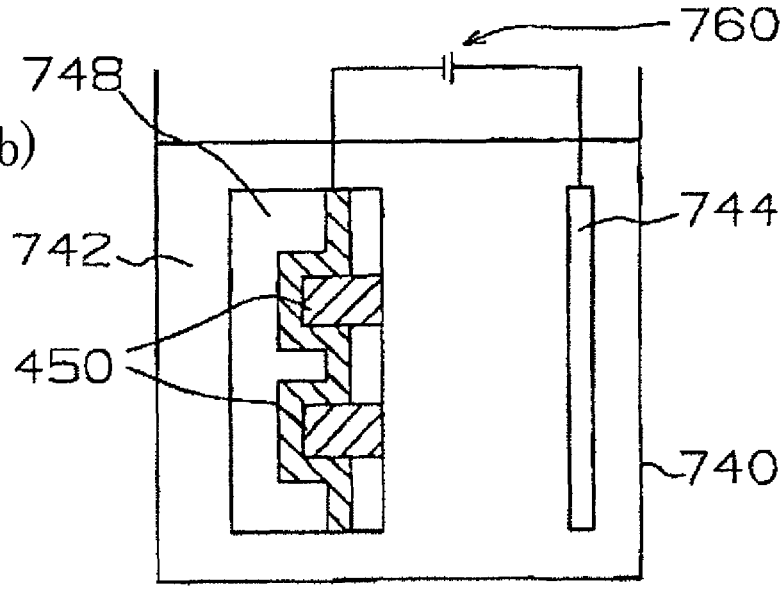

Next, a specific method of the electroforming process will be explained with reference to FIG. 18. Referring to FIG. 18(*a*), it is necessary to select electroforming solution according to the metal material which is to be electroformed. For example, a sulfamate bath, a watt bath, a sulfate bath, and the like are used in the nickel electroforming process. When the nickel electroforming is performed by using the sulfamate bath, a sulfamate bath electroforming solution 742 having hydrated nickel sulfamate salt as the main component is added into a treatment tank 740 for the electroforming process. An anodic electrode 744, which is formed of the metal material to be electroformed, is immersed into the sulfamate bath 742. For example, the anodic electrode 744 may be configured by preparing a plurality of balls formed of the metal material which is to be electroformed and putting the metal balls into a metal basket which is formed of titanium or the like. An electroforming mold 748 which is to perform the electroforming process is immersed into the sulfamate bath 742.

Referring to FIG. 18(*b*), if the electroforming mold 748 is connected to a cathode of a power supply 760 and the anodic electrode 744 is connected to an anode of the power supply 760, the metal configuring the anodic electrode 744 is ionized, move into the sulfamate bath, and is precipitated on an electroforming mold 748 type cavity 748*f*. A valve (not shown) may be connected to the treatment tank 740 via piping (not shown). A filter for filtration is provided in the piping and may filter the sulfamate bath which is discharged from the treatment tank 740. The filtered sulfamate bath can be returned into the treatment tank 740 from an injection pipe (not shown).

Referring to FIG. 17(*d*), the resist 428 for forming the external shape is removed from the substrate 420, and the electroforming component 432 is dismounted (process 409). The electroforming component 432 includes the shaft component 426 and the electroforming metal portion 430 which is integrated to the shaft component 426. Since the flange 426*f* of the shaft component 426 is disposed in the electroforming metal portion 430, there is no concern that the shaft component 426 may be separated from the electroforming metal portion 430.

In addition, as a modification, only the main body portions (locking stone support arm, one side actuating spring, one side actuating spring support arm, balance spring) of the blade is manufactured by the electroforming process, thereafter, the shaft components (blade shaft and balance spring adjustment eccentric pin) may be fixed as the following process. If this method is used, it is possible to simplify the processes of the electroforming process.

If the method of manufacturing the electroforming component is used, it is not necessary to drive in other components to the electroforming metal portion which is manufactured by the electroforming process nor is it necessary to attach other components to the electroforming metal portion by adhesion or the like. Therefore, by using the method of manufacturing the electroforming component, the metal component and the metal component (shaft or the like) can be integrally electroformed to each other, and the metal component and the non-conducting component (shaft or the like) are integrally electroformed to each other. That is, by using the method of manufacturing the electroforming component, since the metal component and the metal component or the metal component and the non-conducting component are integrally electroformed to each other, the mechanical component including a plurality of components can be formed without preparing the posterior process. In addition, the inner stress which is generated in the electroforming component can be adjusted by adjusting the processing condition of the electroforming, and it is possible to firmly fix the non-conducting component to the electroforming metal portion without damaging the electroforming component by controlling the attachment pressure of the non-conducting component.

Moreover, various shape profiles which are recessed and projected in the radial direction can be provided in the fixing portion of the component which is to be fixed to the electroforming metal portion. For example, as the shape profile which is recessed and projected in the radial direction, there may be a flange, a wavy portion, a male screw portion, a knurled portion, a roundly cut portion, and a groove portion. In the shape profiles, which are recessed and projected in the radial direction and are to be provided in the component which is to be fixed to the electroforming metal portion, respectively, one or a plurality, or a plurality to which some kinds of the shape profiles are combined are provided to the fixing portion of the component which is to be fixed to the electroforming metal portion. Therefore, it is possible to effectively and reliably prevent the component which is to be fixed to the electroforming metal portion from being extracted from the electroforming metal portion, falling out of the electroforming metal portion, and sliding with respect to the electroforming metal portion. That is, by disposing the shape profile which is recessed and projected in the radial direction in the electroforming metal portion, the contact area between the component which is to be fixed to the electroforming metal portion and the electroforming metal portion can be increased. Therefore, the component which is to be fixed to the electroforming metal portion can be suppressed from falling out of the electroforming metal portion, and the component which is to be fixed to the electroforming metal portion can be effectively suppressed from being rotated to the electroforming metal portion. That is, the shape profile, which is provided in the component which is to be fixed to the electroforming metal portion and is recessed and projected in the radial direction, is configured so as to be disposed in the electroforming metal portion which is integrally formed with the component which is to be fixed to the electroforming metal portion. Therefore, the shape profile is configured so as to inhibit the falling out of the component which is to be fixed to the electroforming metal portion, the rotating of the component which is to be fixed to the electroforming metal portion, and the like.

(3-2) Second Manufacturing Process for Blade

In the embodiment of the detent escapement of the present invention, the locking stone 132 may be integrally formed with the blade 130. According to a second manufacturing process explained below, the locking stone 132 may be integrally formed with the blade 130 through the electroforming process.

Referring to FIG. 34(*a*), a substrate 501, which is used for manufacturing the electroforming component, is prepared. The material which configures the substrate 501 includes silicon, glass, plastic, stainless steel, aluminum, or the like. For example, the size of the substrate 501 is 2 inch (about 50 mm) to 8 inch (about 200 mm). For example, the thickness of the substrate 501 is 300 μm to 625 μm at the case of the silicon substrate of 4 inch.

A conductive layer 502 is deposited on the substrate 501, and a photoresist 503 is deposited on the conductive layer 502. It is preferable that the thickness of the conductive layer 502 is a range of dozens nm to several 1 μm. The thickness of the photoresist 503 is a range of several 1 μm to several mm. It is preferable that the thickness of the photoresist 503 is the approximately same as the thickness of a first stage (that is, a first stage of an electroforming mold 511) of the electroforming component which is manufactured. An insoluble portion 503*a* and a soluble portion 503*b* are formed by using a photomask (not shown). The material which configures the conductive layer 502 includes gold (Au), silver (Ag), nickel (Ni), copper (Cu), or the like. The photoresist 503 may be a negative type or a positive type. It is preferable that the photoresist 503 uses a chemically amplified photoresist which is based on epoxy resin.

The conductive layer 502 may be formed by a sputtering method, and may be also formed by a vacuum vapor deposition method. The method which deposits the photoresist 503 may be a spin coating, a dip coating, or a spray coating, and the photoresist may be formed by overlapping a plurality of sheet-like photoresist films. In order to form the insoluble portion 503*a* and the soluble portion 503*b*, the photoresist is exposed to ultraviolet light through a photomask (not shown). When the photoresist 503 is the chemically amplified type, the photoresist is subject to a PEB (Post Exposure Bake) after being exposed to the ultraviolet light.

Referring to FIG. 34(*b*), next, a metal layer 505 is deposited without performing the development of the photoresist 503. It is preferable that the thickness of the metal layer 505 is a range of several nm to several μm. The photoresist 503 is a positive type, in a case of a pattern in which the insoluble portion 503*a* is irradiated with an exposure light at the process after the second stage of the electroforming mold 511, the thickness of the metal layer 505 is several 10 nm or more, and it is preferable that the metal layer has a light shielding property in which the insoluble portion 503*a* is not irradiated with the exposure light. The material of the metal layer 505 includes gold (Au), silver (Ag), nickel (Ni), copper (Cu), or the like. The method which deposits the metal layer 505 may be a vapor phase deposition method such as a sputtering method or a vacuum vapor deposition method, or a wet method such as electroless plating.

Next, referring to FIG. 34(*c*), a photoresist 506 is deposited on the metal layer 505, and an insoluble portion 506*a* and a soluble portion 506*b* are formed. It is preferable that the thickness of the photoresist 506 is a range of several μm to several mm and is the approximately same as the thickness of a second stage (that is, a second stage of an electroforming mold 511) of the electroforming component which is manufactured. The photoresist 506 may be a negative type or a positive type. It is preferable that the photoresist 506 uses a chemically amplified photoresist which is based on epoxy resin. The photoresist 506 may be the same as the photoresist 503 or may be different from the photoresist 503. The method which deposits the photoresist 506 may be a spin coating, a dip coating, or a spray coating, and the photoresist may be formed by overlapping a plurality of sheet-like photoresist films. In order to form the insoluble portion 506*a* and the soluble portion 506*b*, the photoresist is exposed to ultraviolet light through a photomask (not shown). When the photoresist 506 is the chemically amplified type, the photoresist is subject to a PEB (Post Exposure Bake) after being exposed to the ultraviolet light.

Next, referring to FIG. 34(*c*), the substrate 501 is immersed into a developing solution, and the photoresist 503 and the photoresist 506 are developed. At this time, the electrode 505 on the soluble portion 503*b* is removed by a lift-off process, the electrode 505*a* on the insoluble portion 503*a* remains, and the electroforming mold 511 can be obtained. In order to remove the soluble portion 503*b*, the soluble portion 506*b*, and the unnecessary electrode 505, the development may be performed by applying an ultrasonic vibration.

Figure 35:
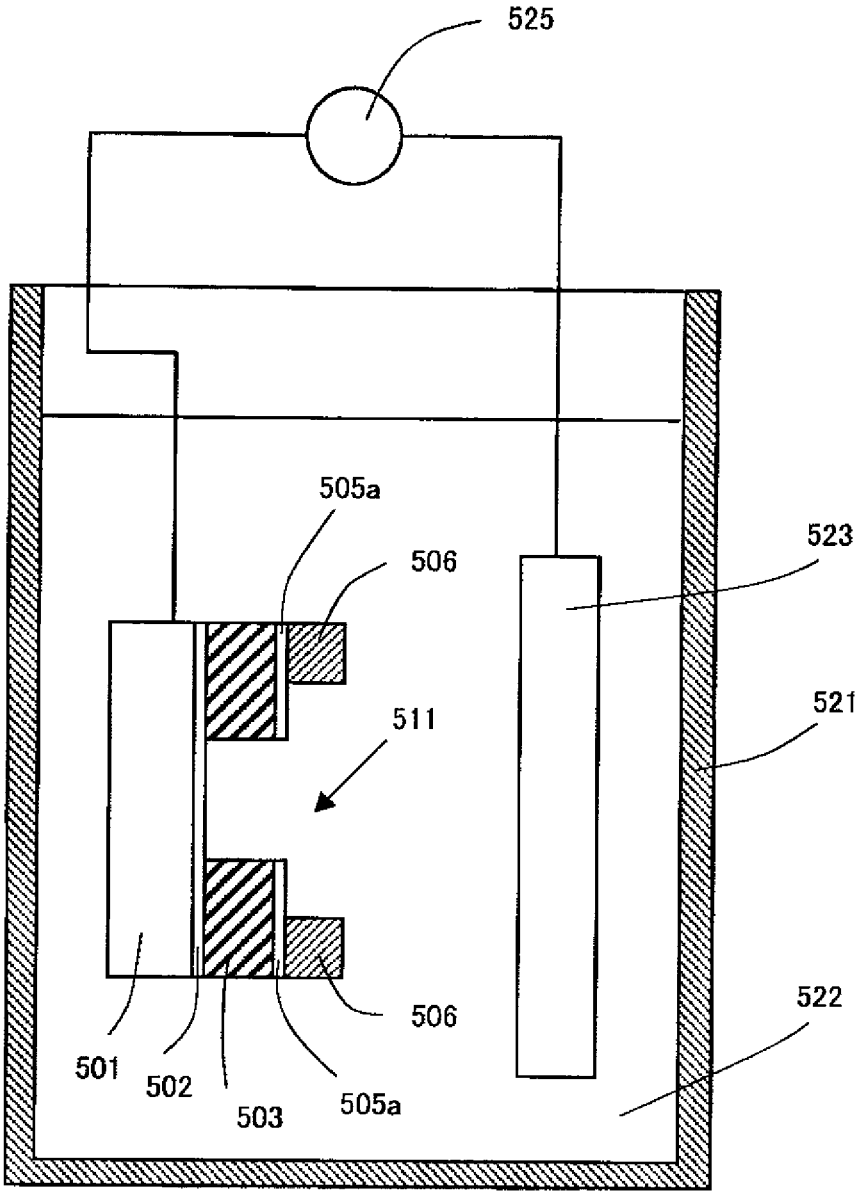
FIG. 35 is a diagram illustrating a portion of the second manufacturing process for the blade in the embodiment of the detent escapement of the present invention.
Figure 36A:
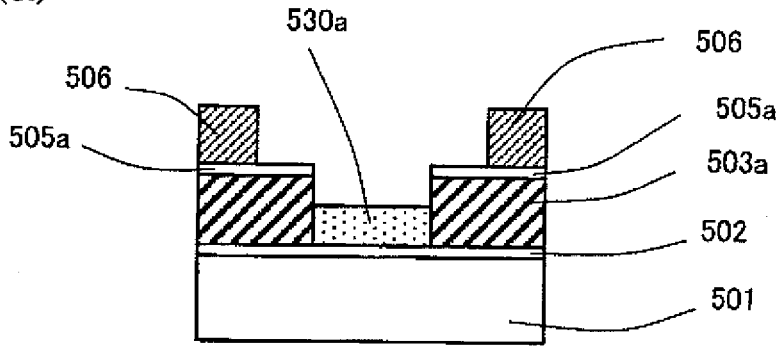
FIGS. 36(*a*)-36(*d*) are diagrams illustrating a portion of the second manufacturing process for the blade in the embodiment of the detent escapement of the present invention.
Figure 36B:
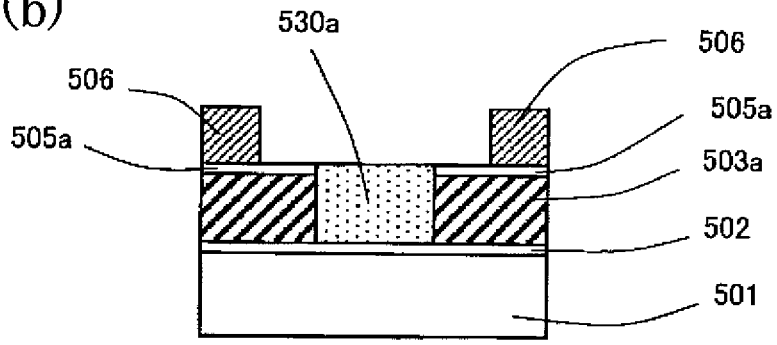
Figure 36C:
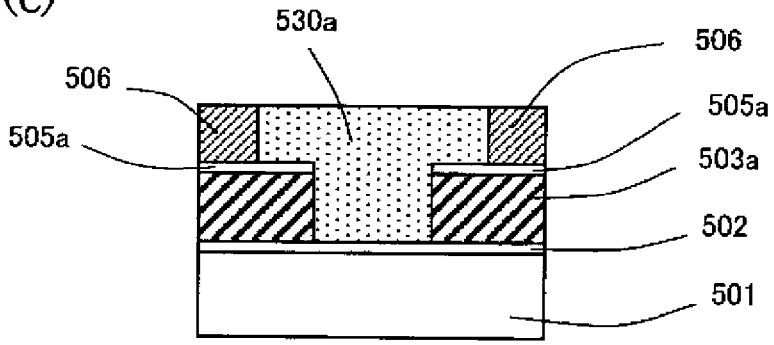
Figure 36D:
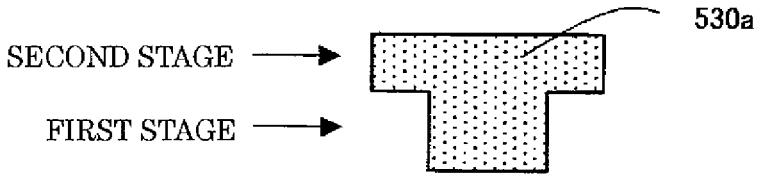

Referring to FIG. 35, the electroforming tank is filled with an electroforming solution 522. The electroforming mold 511 and the electrode 523 are immersed in the electroforming solution 522. When a nickel is precipitated, an aqueous solution containing a hydrated nickel sulfamate salt is used as the electroforming solution 522. When the nickel is precipitated, the material of the electrode 523 is nickel. The conductive layer 502 of the electroforming mold 511 is connected to a power supply 525. Electrons are supplied through the conductive layer 502 according to the voltage of the power supply 525, and a metal is precipitated from the conductive layer 502. The precipitated metal is grown in the thickness direction of the substrate 501.

Referring to FIG. 36(*a*), an electroformed material 530*a* is precipitated from the conductive layer 502. At this time, since current does not flow to the electrode 505*a*, the electroformed material 530*a* is not precipitated on the electrode 505*a*.

Referring to FIG. 36(*b*), since current does not flow to the electrode 505*a*, the electroformed material 530*a* is not precipitated on the electrode 505*a*. If the electrode 505*a* and the electroformed material 530*a* contact each other, the current flows to the electrode 505*a*, and the electroformed material 530*a* is precipitated on the electrode 505*a*.

Referring to FIG. 36(*c*), after the electroformed material 530*a* is precipitated on the electrode 505*a* up to a desired thickness, the thickness of the electroformed material 530*a* is aligned by a grinding process. In the electroforming process, when the thickness of the electroformed material 530*a* can be controlled, the grinding process may be not performed.

Referring to FIG. 36(*d*), an electroforming component 530 is obtained by extracting the electroformed material 530*a* from the electroforming mold 511. The process which extracts the electroformed material 530*a* from the electroforming mold 511 may be performed by solving the insoluble portion 503*a* and the insoluble portion 506*a* with an organic solvent, or by applying the force which is separated from the substrate 501 to the electroformed material 530*a* and physically peeling off the electroformed material 530*a* from the substrate 501. When the conductive layer 502 and the electrode 505*a* are attached to the electroformed material 530*a*, the conductive layer 502 and the electrode 505*a* are removed from the electroformed material 530*a* by wet etching, grinding, or the like.

By adopting the processes described above, the locking stone 132 can be formed at the first stage of the electroforming mold 511 and a blade 130 can be formed at the second stage of the electroforming mold 511. That is, the locking stone 132 is formed at the first stage of the electroforming mold 511, and the locking stone support arm 131, the one side actuating spring 140, the one side actuating spring support arm 133, and the balance spring 150 can be integrally formed at the second stage of the electroforming mold 511. Alternatively, the locking stone 132 is formed at the first stage of the electroforming mold 511, and the locking stone support arm 131, the one side actuating spring 140, and the one side actuating spring support arm 133 can be integrally formed at the second stage of the electroforming mold 511. According to the above-described process, the one side actuating spring 140 having an aspect ratio of 1 to 5 can be integrally formed to the blade 130.

In addition, according to the above-described manufacturing method, at least two of the locking stone support arm 131, the one side actuating spring 140, the one side actuating spring support arm 133, and the balance spring 150 may be simultaneously formed, and all the above-described those may be formed non-simultaneously.

(3-3) Third Manufacturing Method for Blade (Bosch Process)

Figure 37:
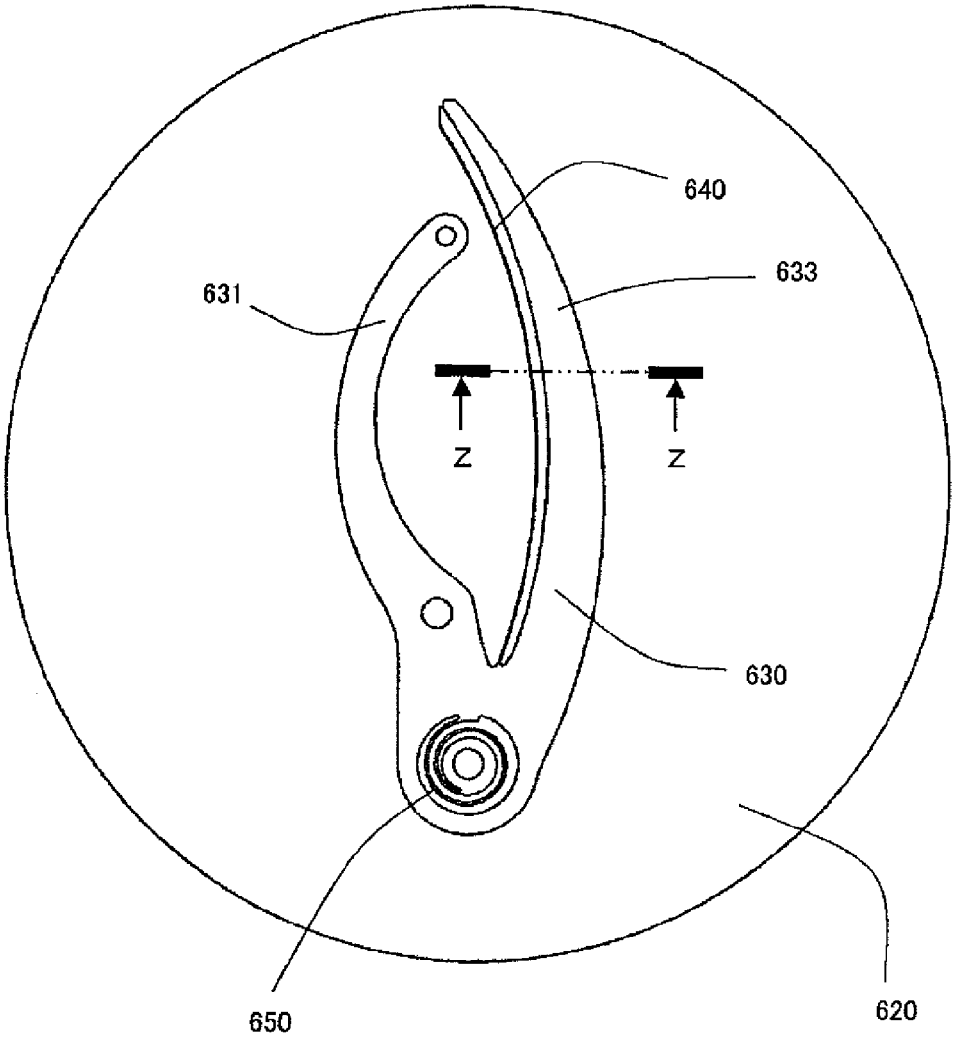
FIG. 37 is a diagram illustrating a process which forms the blade in a substrate in a third manufacturing process for the blade in the embodiment of the detent escapement of the present invention.

According to a third manufacturing method explained below, at least two of the locking stone support arm 131, the one side actuating spring 140, the one side actuating spring support arm 133, and the balance spring 150 can be simultaneously formed. Referring to FIG. 37, a blade 630 can be formed by using a substrate 620 through the third manufacturing process.

Figure 38:
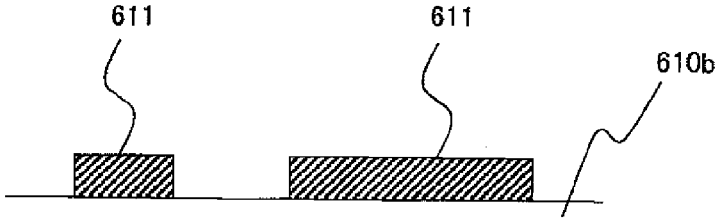
FIG. 38 is a diagram illustrating a portion of the third manufacturing process for the blade in the embodiment of the detent escapement of the present invention.

Referring to FIGS. 37 and 38, a photoresist 611 is irradiated with exposure light such as ultraviolet rays or X-rays by using a photomask (not shown) in which patterns of a one side actuating spring 640 and a one side actuating spring support arm 633 are formed, and the photoresist 611 of the portion in which the one side actuating spring 640 and the one side actuating spring support arm 633 are present is cured. Moreover, the portion of the uncured photoresist 611 is removed, and the etching pattern is completed.

In FIG. 38, in a portion of a cross-section taken along a line Z-Z of FIG. 37, two places of photoresists 611 of the positions corresponding to the actuating spring 640 and the one side actuating spring support arm 633 are indicated. The one side actuating spring 640 and the one side actuating spring support arm 633 are formed by performing the etching while continuously forming a trough 615 in an active layer 610*b*. Hereafter, the third manufacturing process will be explained in detail with reference to FIGS. 39 to 44.

Figure 39:
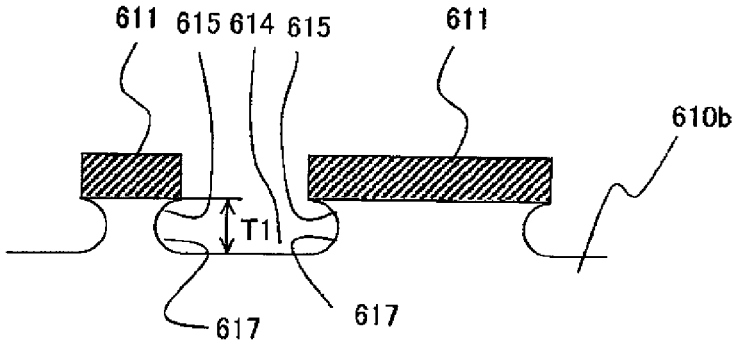
FIG. 39 is a diagram illustrating a portion of the third manufacturing process for the blade in the embodiment of the detent escapement of the present invention.

FIG. 39 is a diagram illustrating a first Si etching process. The thickness of Si which is cut by one-time Si etching process is set to T1. Here, a concave portion 614 is formed between adjacent photoresists 611. Moreover, the portion to which the photoresist 611 is not present and the Si surface is exposed is etched. However, a side surface 617 of the active layer 610*b* under the photoresist 611 is also partially etched by performing isotropic etching, and the through 615 is formed. By controlling the thickness T1 which is etched, a radius R1 of the trough 615 of the side surface 617, which corresponds to the one side actuating spring 640 and the one side actuating spring support arm 633, may be arbitrary size. In this way, one trough 615 corresponding to one crest 626*m* is formed by a single round of isotropic etching.

Figure 40:
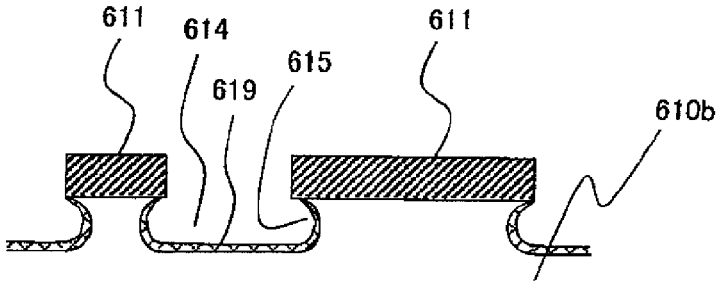
FIG. 40 is a diagram illustrating a portion of the third manufacturing process for the blade in the embodiment of the detent escapement of the present invention.

FIG. 40 is a diagram in which a protective film is formed. A protective film 619 is formed on the first etching surface (concave portion 14) so that the active layer 610*b* under the photoresist 611 is not cut more than the state of FIG. 39 by a second etching. For example, the protective film 619 is formed of fluorocarbon or the like. In the protective film 619, a film is formed on the Si surface through a CVD method by using $C_4F_8$ gas or the like.

Figure 41:
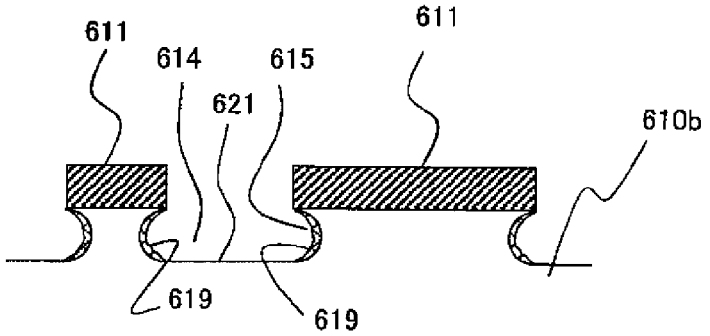
FIG. 41 is a diagram illustrating a portion of the third manufacturing process for the blade in the embodiment of the detent escapement of the present invention.

FIG. 41 is a diagram in which only the protective film 619 of the bottom surface 621 of the concave portion 614 is removed. The active layer 610*b* (Si surface) is exposed by remaining the protective film 619 of the side surface (side surface 617) of the concave portion 614 and removing only the protective film 619 of the bottom surface 621. In this way, in order to remove only the protective film 619 of the bottom surface 621, for example, if the etching is performed by using $SF_6$ gas, the ion perpendicularly collides with respect to the protective film 619 of the bottom surface 621, and only the protective film 619 of the bottom surface 621 is removed by the impact of the ion.

Figure 42:
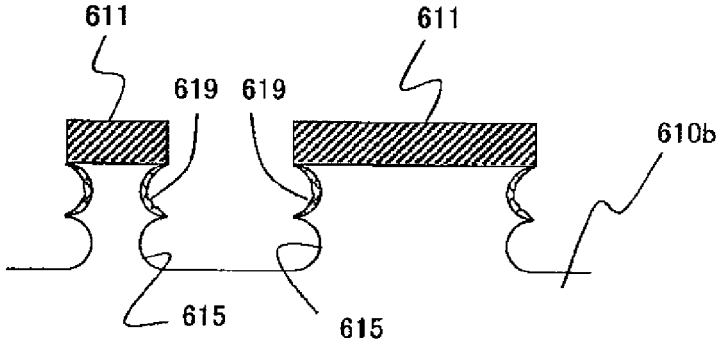
FIG. 42 is a diagram illustrating a portion of the third manufacturing process for the blade in the embodiment of the detent escapement of the present invention.

FIG. 42 is a diagram illustrating a second Si etching process. Similarly to FIG. 39, the isotropic etching of Si is performed. Thereby, Si of the bottom surface 621 on which the protective film 619 is not formed is isotropically etched. Thereafter, from the process shown in FIG. 40 to the process shown in FIG. 42 is performed in a predetermined number.

Figure 43:
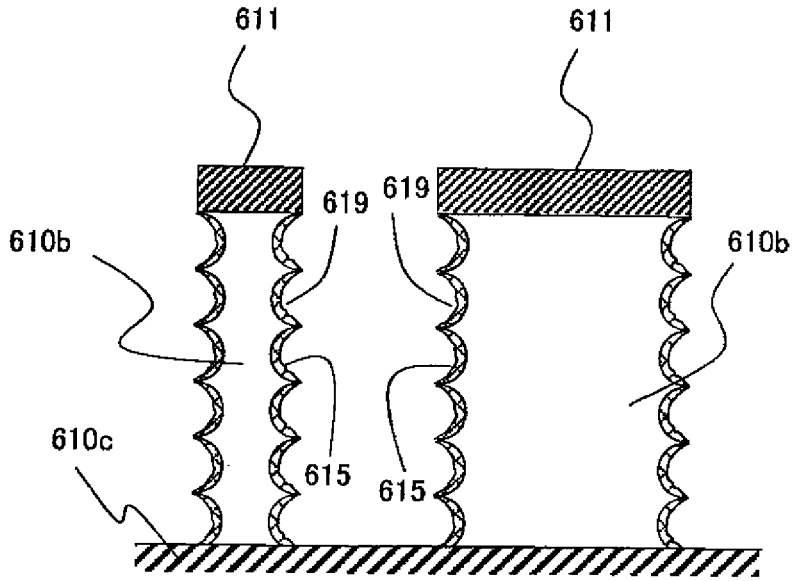
FIG. 43 is a diagram illustrating a portion of the third manufacturing process for the blade in the embodiment of the detent escapement of the present invention.

FIG. 43 is a diagram in which the Si etching, the protective film formation and the removal of the protective film of the bottom surface are repeatedly performed up to reaching a BOX layer ($SiO_2$ surface) 610*c*. The Si etching process shown in FIG. 39, the protective film formation process shown in FIG. 40, and the process of removing the protective film shown in FIG. 41 are repeatedly performed up to reaching the BOX layer 610*c* of the substrate 610.

Figure 44:
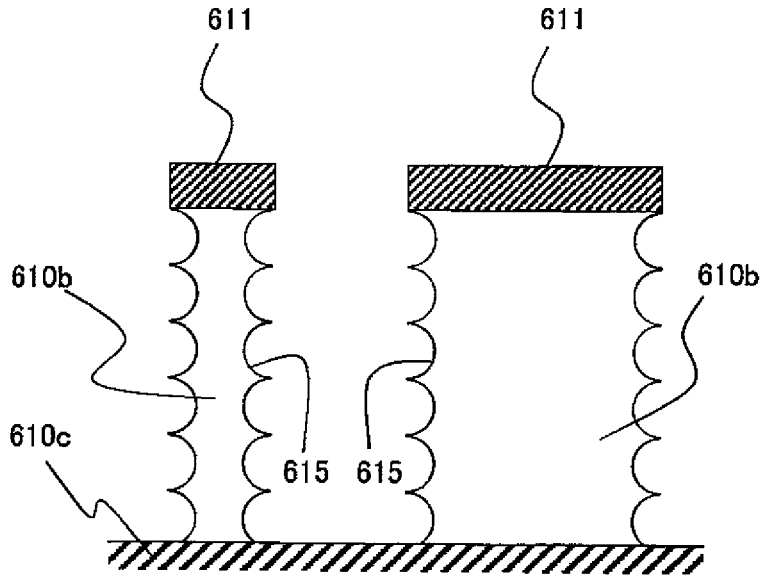
FIG. 44 is a diagram illustrating a portion of the third manufacturing process for the blade in the embodiment of the detent escapement of the present invention.

FIG. 44 is a diagram in which the entire protective film 619 is removed. The protective film 619 is removed by an oxygen plasma asking. The protective film 619 which is formed at the side surface 617 of the active layer 610*b* is removed. The portion in which the protective film 619 is removed corresponds to the one side actuating spring 640 and the one side actuating spring support arm 633.

As described above, according to the third manufacturing process, the one side actuating spring 640 and the one side actuating spring support arm 633 can be simultaneously formed. That is, the blade which is the component of the detent escapement can be efficiently manufactured with high accuracy by applying the third manufacturing process.

(3-4) Fourth Manufacturing Process for Blade (Cryo Process)

According to a fourth manufacturing process explained below, at least two of a locking stone support arm 631, the one side actuating spring 640, the one side actuating spring support arm 633, and the balance spring 650 can be simultaneously formed.

Specifically, first, as shown in the above-described FIG. 38, the photoresists 611 of the positions corresponding to the one side actuating spring 640 and the one side actuating spring support arm 633 are formed in a chamber. Moreover, the photoresist 611 are irradiated with an etching gas including $SF_6$ gas and $O_2$ in a state where the chamber is set to a very low temperature (for example, −193°).

Thereby, the portion of the active layer 610*b* which is not coated with the photoresist 611 is etched in a line shape (not shown). That is, the trough 615 is continuously formed in a wave shape in the side surface of the etching portion of the active layer 610*b* in the above-described third manufacturing process. However, in the fourth manufacturing method, the side surface of the etching portion in the active layer 610*b* is formed in a line shape. By applying the fourth manufacturing process, it is possible to efficiently manufacture the blade which is the component of the detent escapement with high accuracy.

Figure 19:
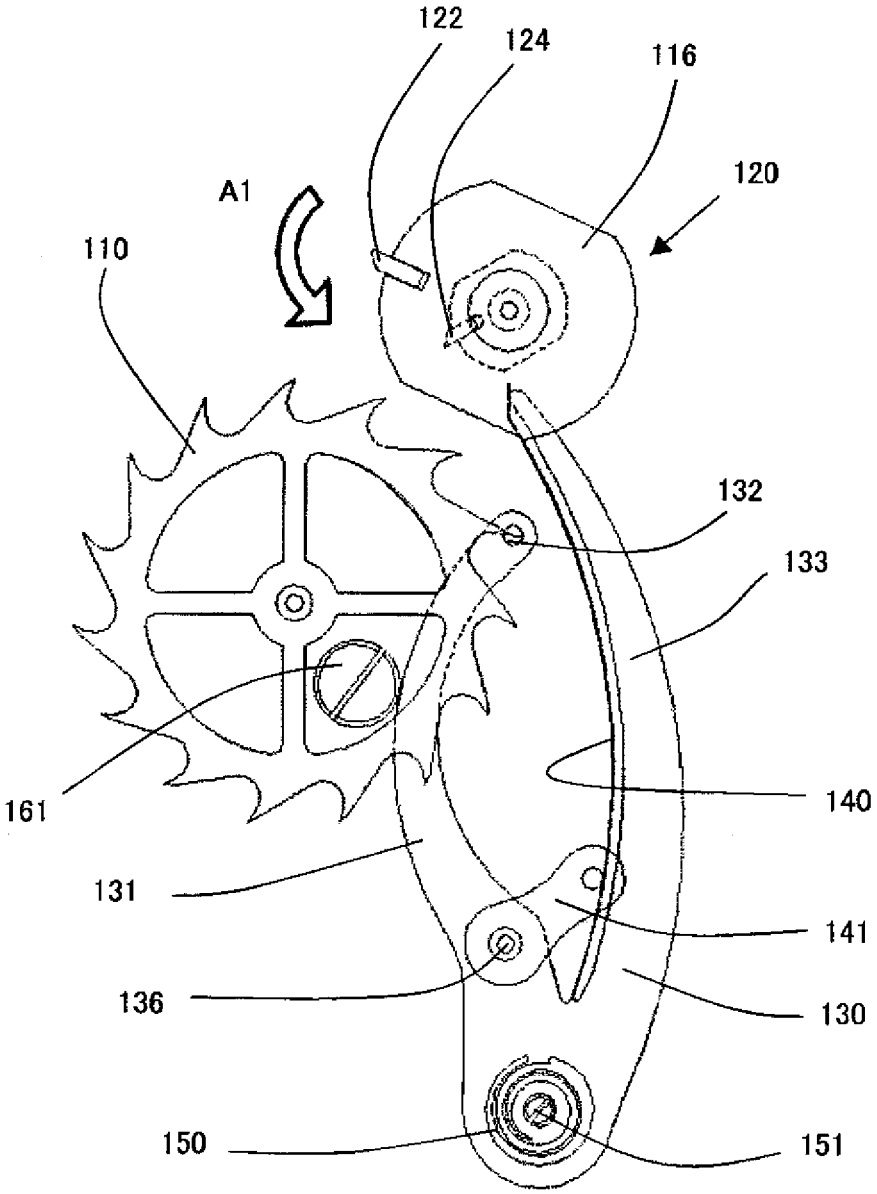
FIG. 19 is a plan view showing a first operating state of the escapement in the embodiment of the detent escapement of the present invention.

(4) Operation of Detent Escapement of the Present Invention (4-1) First Operation Referring to FIG. 19, the balance 120 performs a free oscillation, and the roller table 116 is rotated in a direction of an arrow A1 (counterclockwise direction).

(4-2) Second Operation

Figure 20:
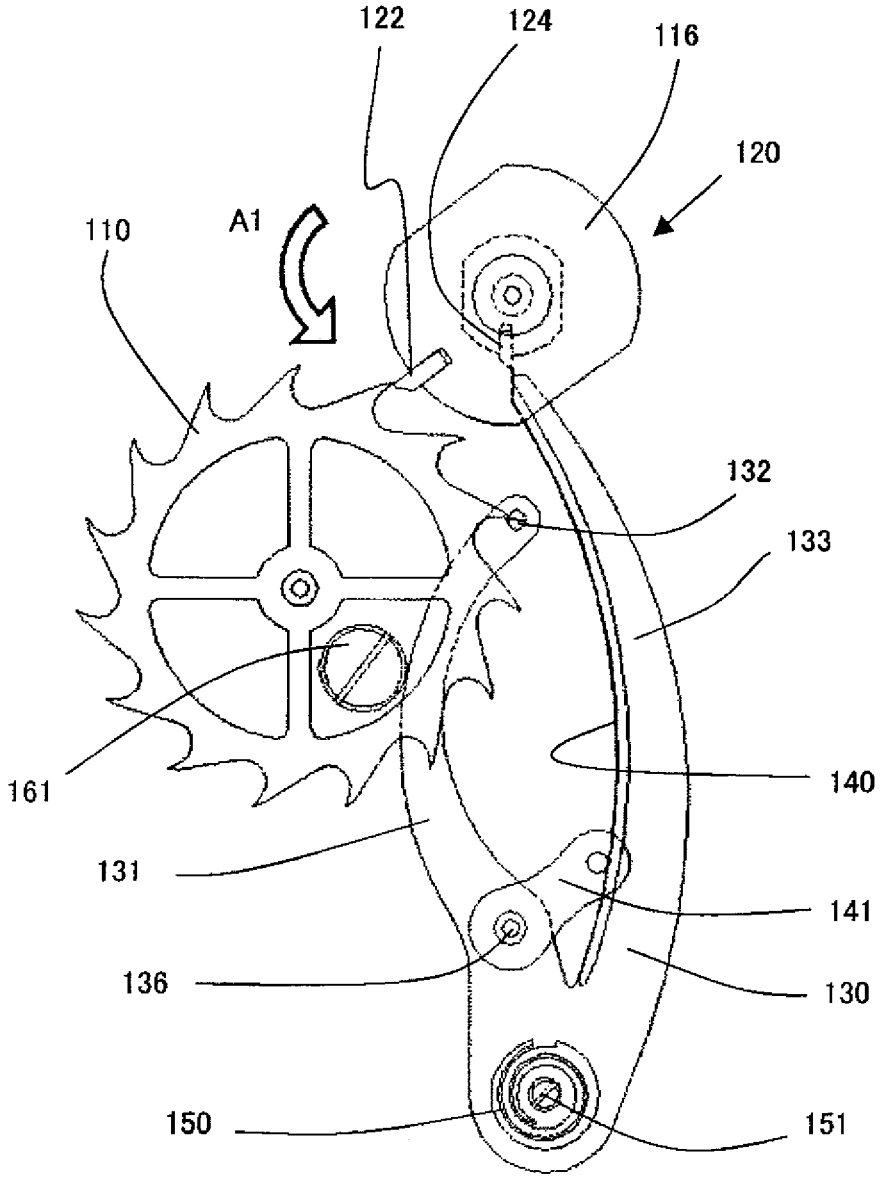
FIG. 20 is a plan view showing a second operating state of the escapement in the embodiment of the detent escapement of the present invention.

Referring FIG. 20, the unlocking stone 124 which is fixed to the roller table 116 is rotated in the direction of the arrow A1 (counterclockwise direction) and contacts the unlocking stone contact portion 140G of the one side actuating spring 140.

(4-3) Third Operation

Figure 21:
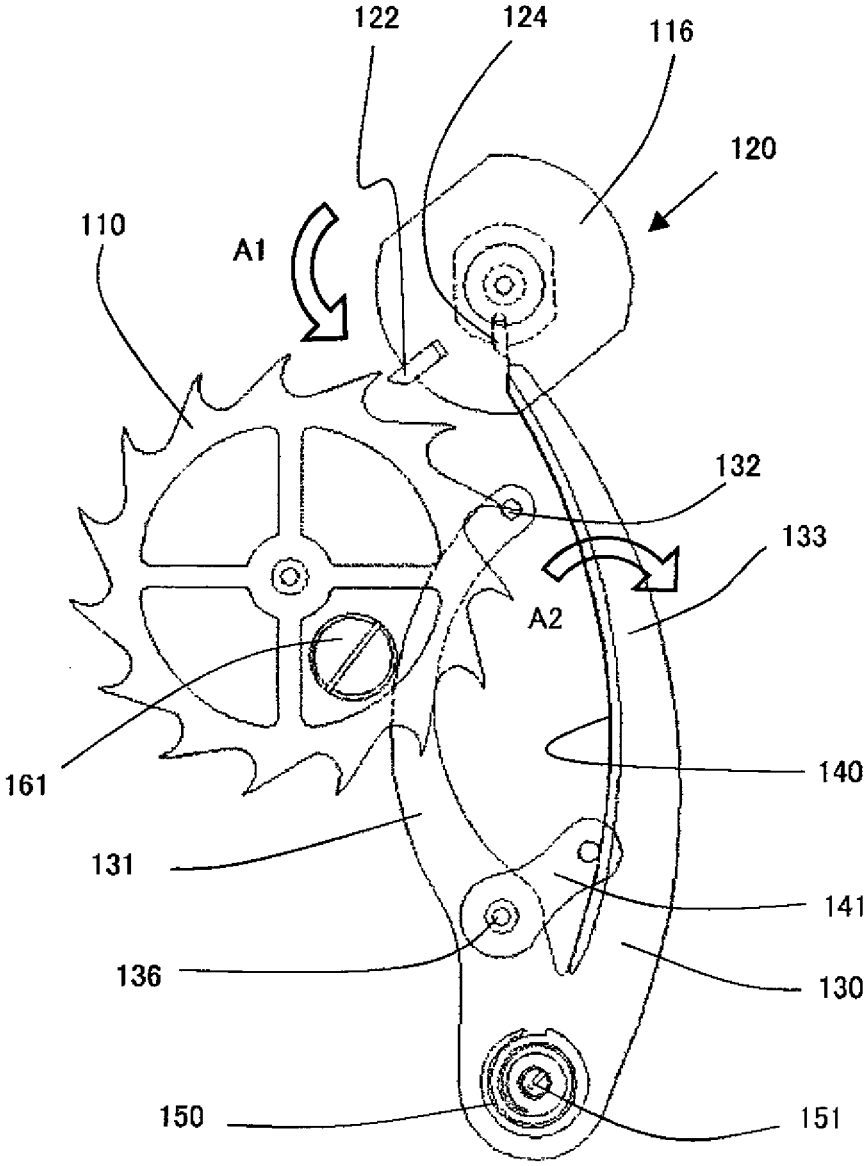
FIG. 21 is a plan view showing a third operating state of the escapement in the embodiment of the detent escapement of the present invention.

Referring to FIG. 21, the unlocking stone 124 is rotated in the direction of the arrow A1 (counterclockwise direction), the one side actuating spring 140 is pressed by the unlocking stone 124, and the spring bearing portion 130D is pressed. Thereby, the blade 130 is rotated in a direction of an arrow A2 (clockwise direction). The tip of the wheel tooth 112 of the escape wheel 110 slides on the contact plane 132B of the locking stone 132.

(4-4) Fourth Operation

Figure 22:
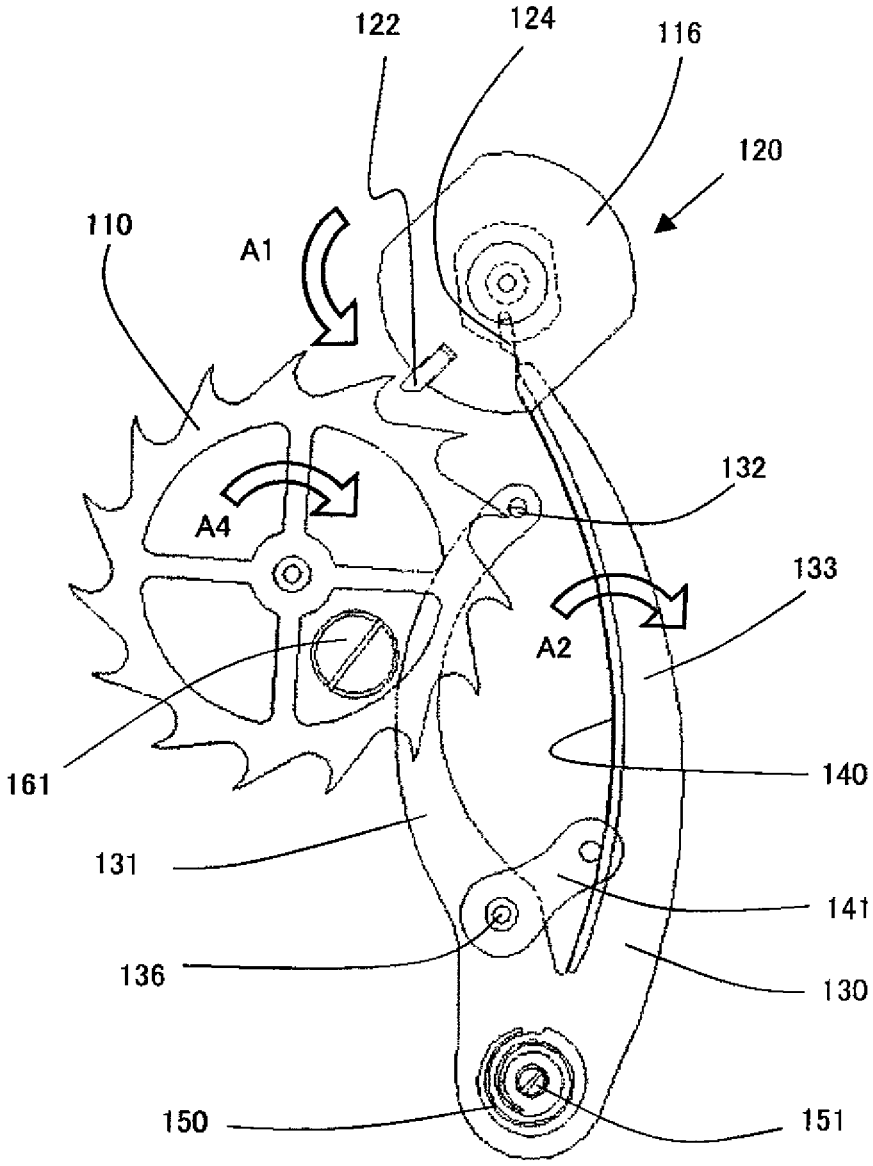
FIG. 22 is a plan view showing a fourth operating state of the escapement in the embodiment of the detent escapement of the present invention.

Referring to FIG. 22, According to the operation in which the blade 130 is rotated in the direction of the arrow A2 (clockwise direction), the locking stone support arm 131 of the blade 130 is separated from the adjustment eccentric pin 161.

(4-5) Fifth Operation

Figure 23:
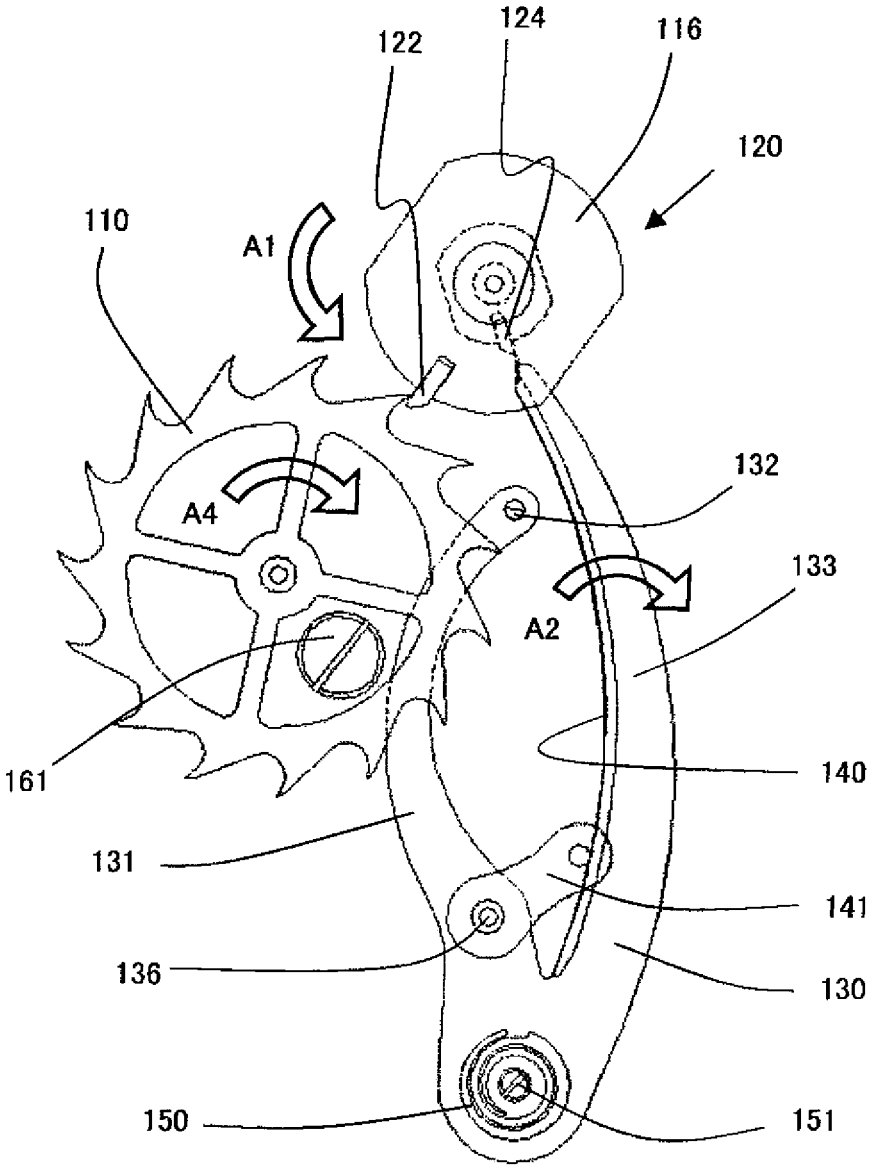
FIG. 23 is a plan view showing a fifth operating state of the escapement in the embodiment of the detent escapement of the present invention.

Referring to FIG. 23, the escape wheel 110 is rotated by the gear train which is rotated by the rotational force when the mainspring is rewound, and the escape wheel 110 is driven. Due to the fact that the escape wheel 110 is rotated in a direction of an arrow A4 (clockwise direction), the tip of the wheel tooth 112 of the escape wheel 110 contacts the impulse pallet 122 and transfers the rotational force to the balance 120. If the roller table 116 is rotated up to a predetermined angle in the direction of the arrow A1 (counterclockwise direction), the unlocking stone 124 is separated from the unlocking stone contact portion 140G of the one side actuating spring 140.

(4-6) Sixth Operation

Figure 24:
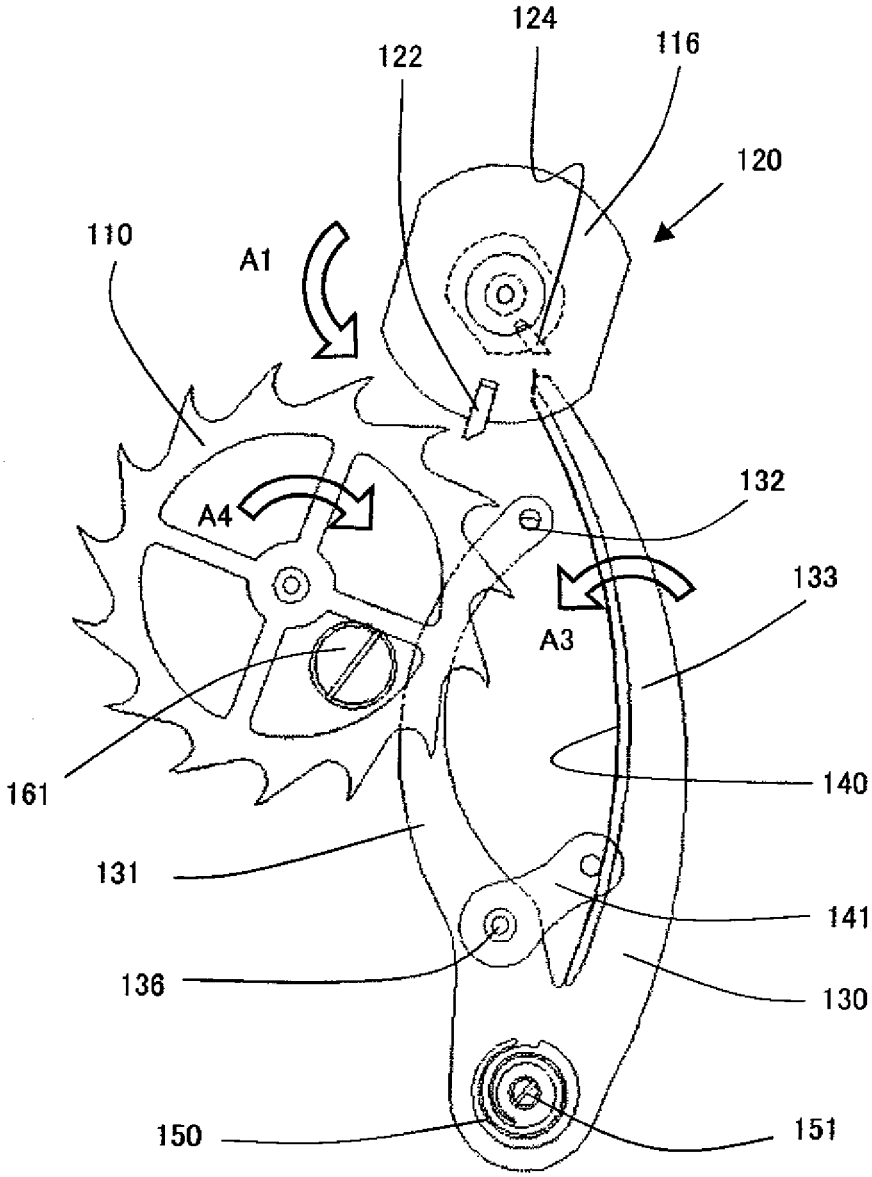
FIG. 24 is a plan view showing a sixth operating state of the escapement in the embodiment of the detent escapement of the present invention.

Referring to FIG. 24, the blade 130 is rotated in the direction of the arrow A3 (counterclockwise direction) by the spring force of the balance spring 150 and tries to return to the initial position. The tip of the wheel tooth 112 of the escape wheel 110, which contacts the contact plane 132B of the locking stone 132, is deviated from the locking stone 132 (escape wheel 110 is released). The blade 130 is rotated in the direction of the arrow A3 (counterclockwise direction) by the spring force of the balance spring 150, and the locking stone support arm 131 of the blade 130 is pushed back toward the adjustment eccentric pin 161.

(4-7) Seventh Operation

Figure 25:
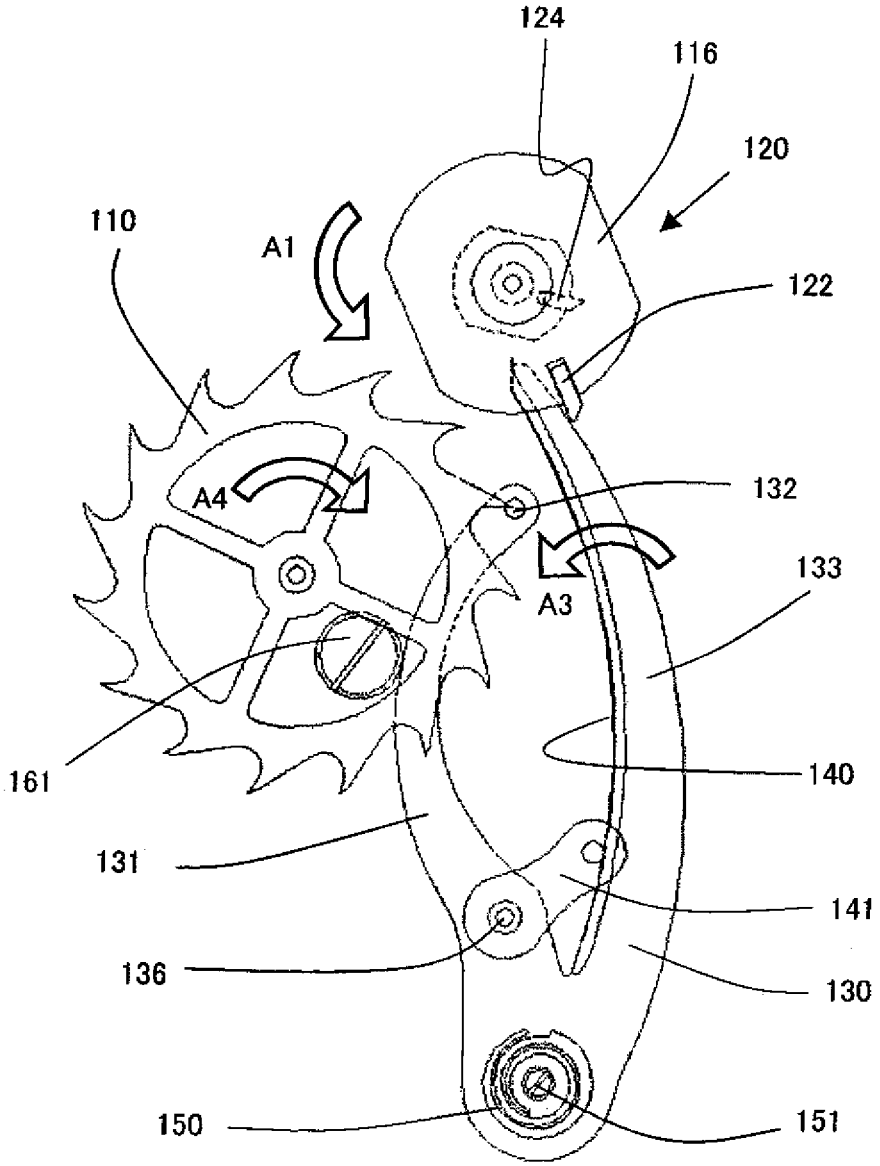
FIG. 25 is a plan view showing a seventh operating state of the escapement in the embodiment of the detent escapement of the present invention.

Referring to FIG. 25, due to the fact that the balance 120 performs a free oscillation in the direction of the arrow A1 (counterclockwise direction), the tip of the next wheel tooth 112 of the escape wheel 110 falls to the contact plane 132B of the locking stone 132. The locking stone support arm 131 of the blade 130 contacts the adjustment eccentric pin 161 by the spring force of the balance spring 150.

(4-8) Eighth Operation

Figure 26:
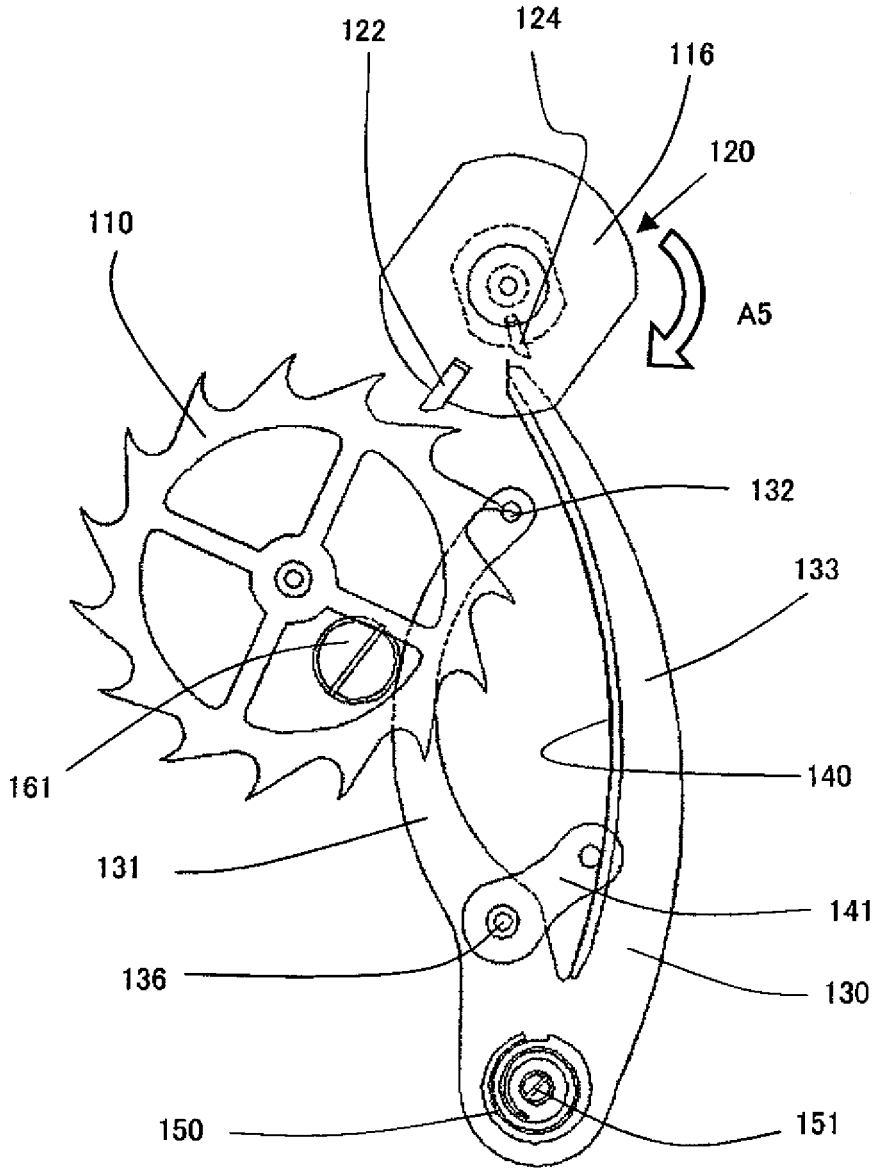
FIG. 26 is a plan view showing an eighth operating state of the escapement in the embodiment of the detent escapement of the present invention.

Referring to FIG. 26, the balance 120 performs a free oscillation, and therefore, the roller table 116 is rotated in a direction of an arrow A5 (clockwise direction).

(4-9) Ninth Operation

Referring to 27(*a*), the unlocking stone 124 which is fixed to the roller table 116 is rotated in the direction of the arrow A5 (clockwise direction) and contacts the unlocking stone contact portion 140G of the one side actuating spring 140. The unlocking stone 124 is rotated in the direction of the arrow A5 (clockwise direction), and the one side actuating spring 140 is pressed by the unlocking stone 124.

Figure 27A:
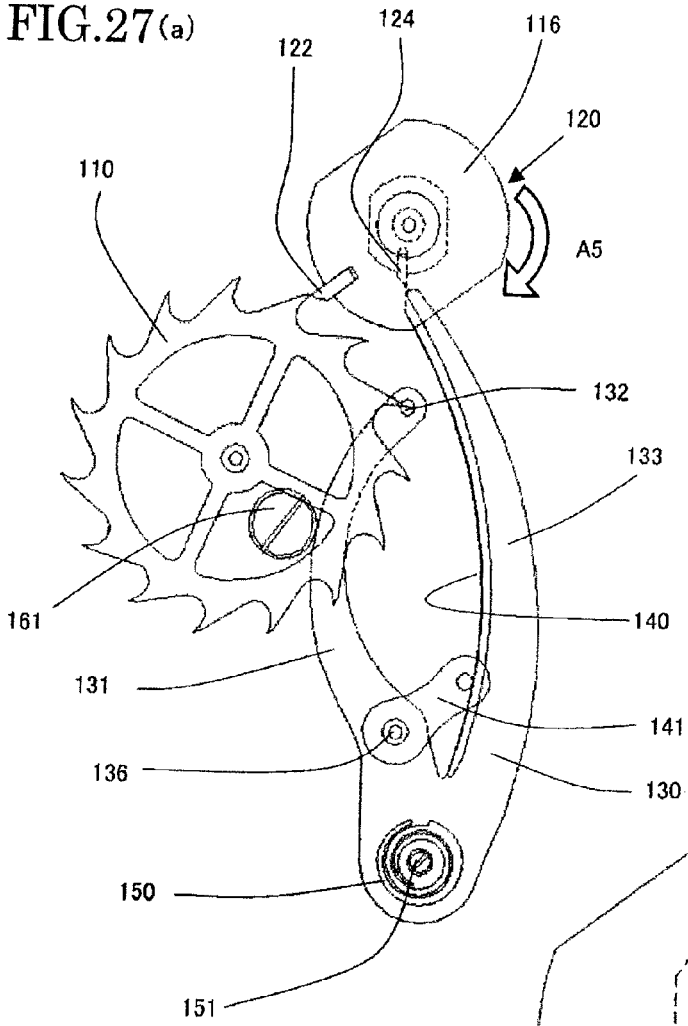
FIG. 27 is a plan view showing a ninth operating state of the escapement in the embodiment of the detent escapement of the present invention, wherein FIG. 27(*a*) is an entire plan diagram, and FIG. 27(*b*) is a partial enlarged plan diagram.
Figure 27B:
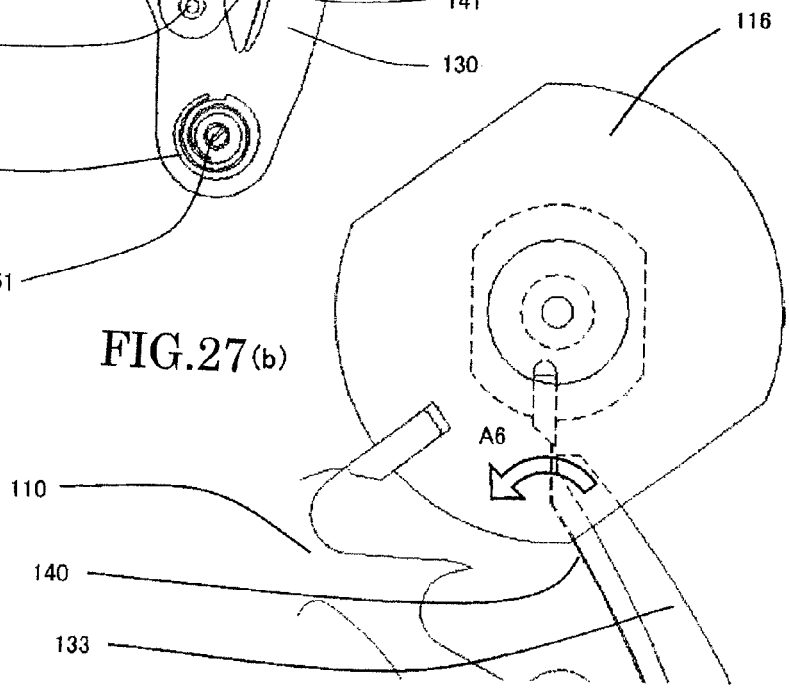

Referring to FIG. 27(*b*), the blade spring 140 is separated from the spring bearing protrusion 130D of the blade 130. Therefore, only the one side actuating spring 140 is pushed to a direction of an arrow A6 (counterclockwise direction) by the unlocking stone 124 in the state where the blade 130 is stationary.

(4-10) Tenth Operation

Figure 28:
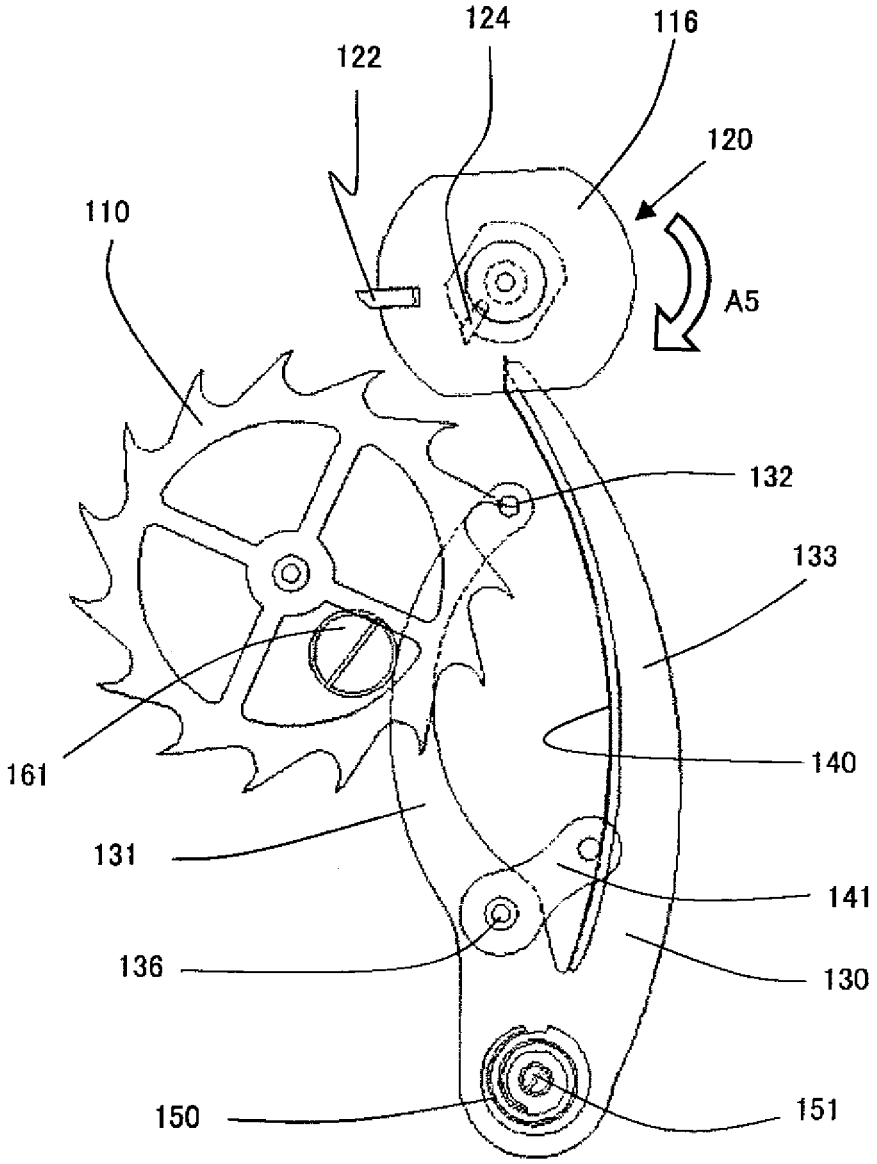
FIG. 28 is a plan view showing a tenth operating state of the escapement in the embodiment of the detent escapement of the present invention.

Referring to FIG. 28, if the roller table 116 is rotated up to a predetermined angle in the direction of the arrow A5 (clockwise direction), the unlocking stone 124 is separated from the unlocking stone contact portion 140G of the one side actuating spring 140. Thereby, the one side actuating spring 140 is returned to the initial position, and the balance 120 performs a free oscillation.

(4-11) Repeating of Operation

Hereinafter, similarly, the operations from the state shown in FIG. 19 to the state shown in FIG. 28 are repeated.

(5) Mechanical Timepiece including Detent Escapement of the Present Invention

In addition, in the present invention, a mechanical timepiece is configured so as to include a mainspring which configures an energy source of the mechanical timepiece, a gear train which is rotated by a rotational force when the mainspring is rewound, and an escapement for controlling the rotation of the gear train, wherein the escapement is configured of the detent escapement. According to this configuration, the mechanical timepiece, which is thin and easily adjusted, can be realized. In addition, in the mechanical timepiece of the present invention, since the transmission efficiency of the force of the escapement is improved, the mainspring can be smaller, or a long-lasting timepiece can be realized by using the barrel drum of the same size.

Figure 31:
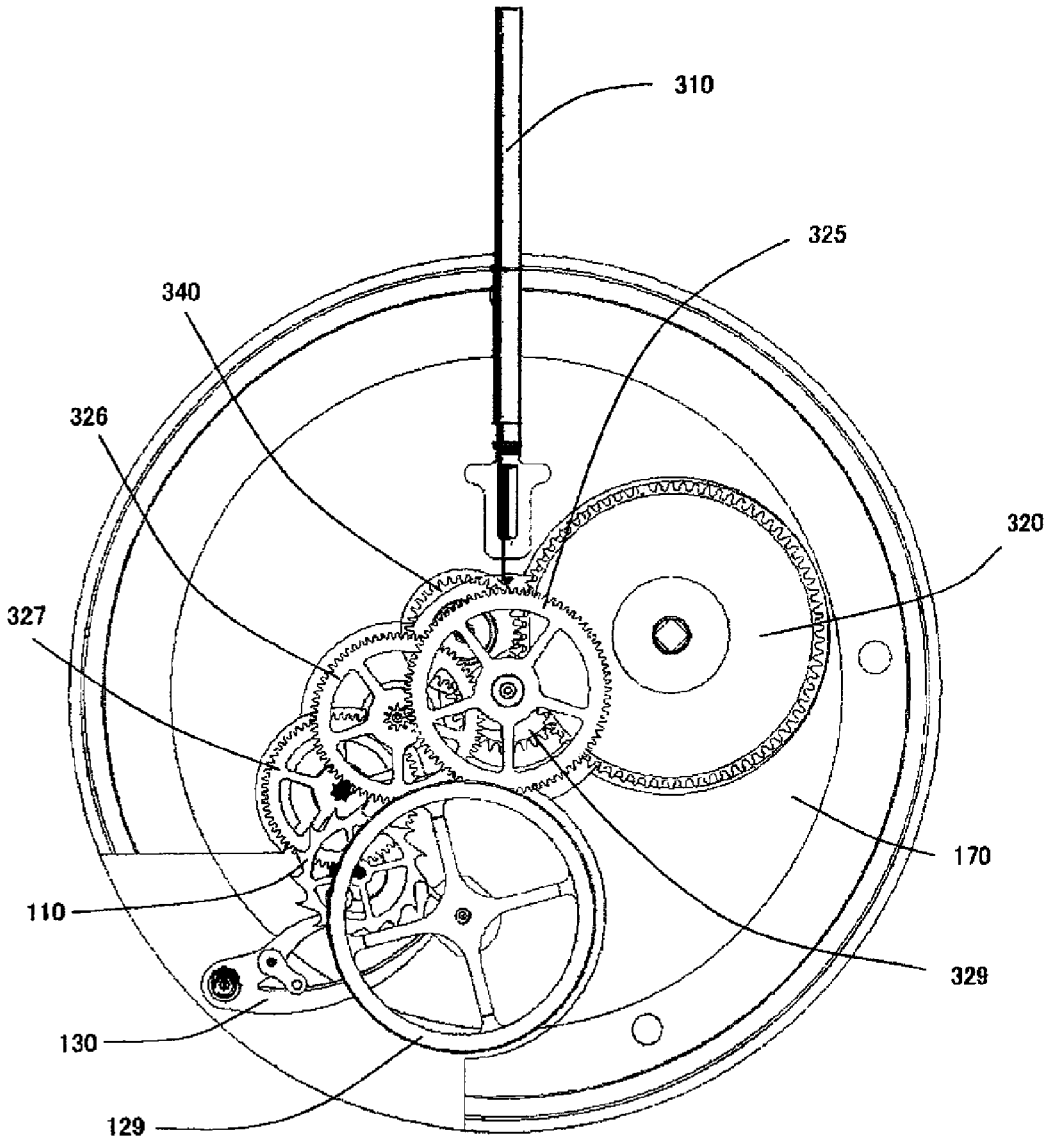
FIG. 31 is a plan diagram showing an outline structure such as a gear train or an escapement when viewed from a case back side of a movement in an embodiment of a mechanical timepiece which uses the detent escapement of the present invention.
Figure 32:
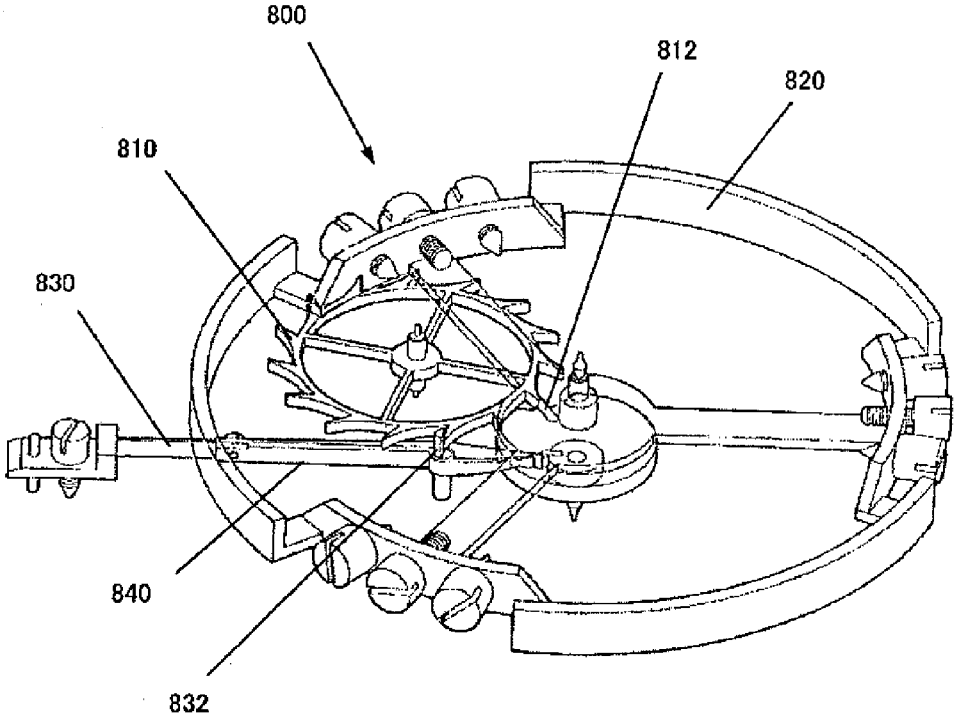
FIG. 32 is a perspective diagram showing the structure of the conventional spring detent escapement.
Figure 33:
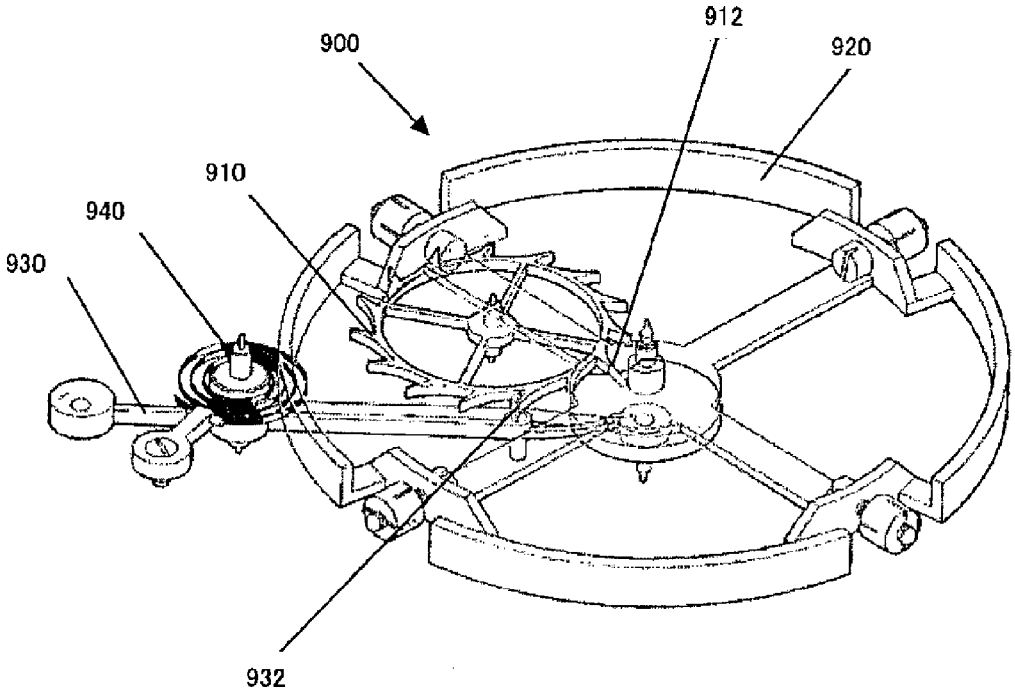
FIG. 33 is a perspective diagram showing the structure of the conventional pivoted detent escapement.
Figure 34A:
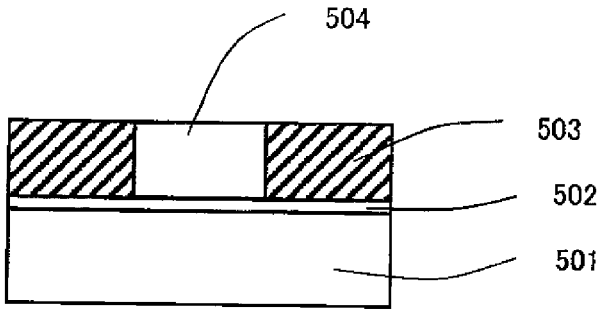
FIGS. 34(*a*)-34(*d*) are diagrams illustrating a portion of a second manufacturing process for the blade in the embodiment of the detent escapement of the present invention.
Figure 34B:
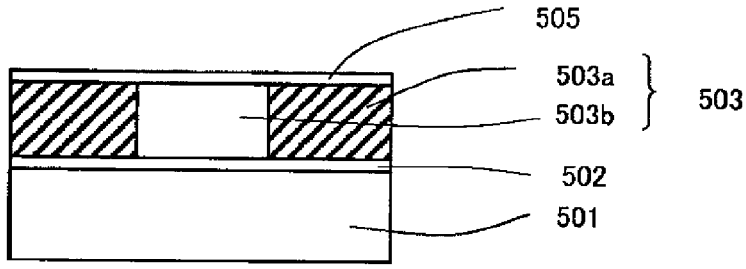
Figure 34C:
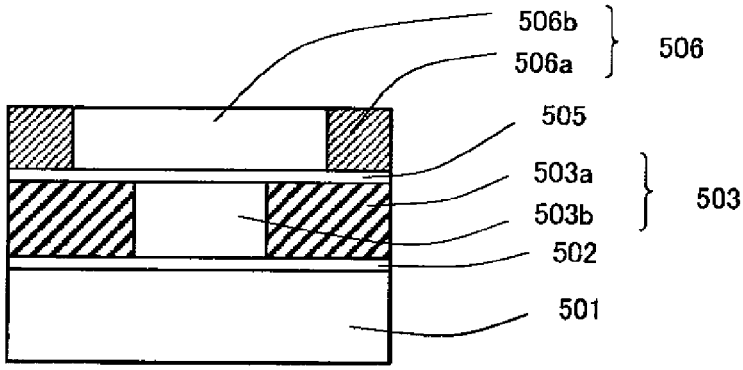
Figure 34D:
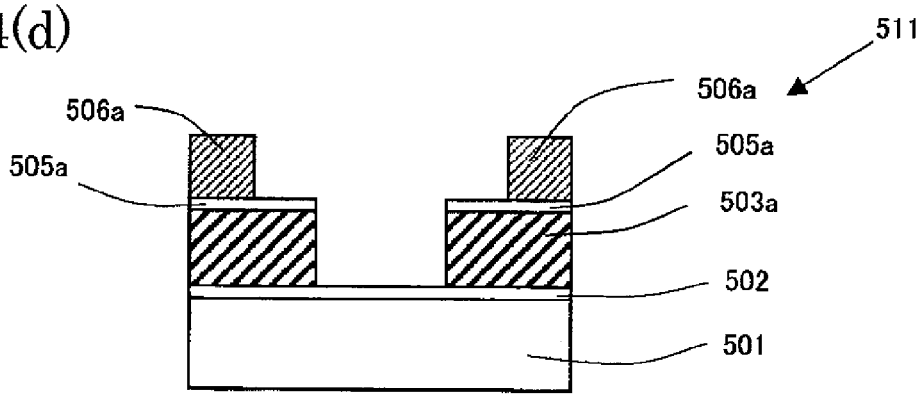

Referring to FIG. 31, in the mechanical timepiece of the present invention, a movement (mechanical body including driving portion of timepiece) 300 includes the main plate 170 which configures the substrate of the movement. A winding stem 310 is disposed at the "direction of three o'clock" of the movement. The winding stem 110 is rotatably incorporated into a winding stem guide hole of the main plate 170. The detent escapement which includes the balance 120, the escape wheel 110, and the blade 130 and the gear train which includes a second wheel & pinion 327, a third wheel & pinion 326, a center wheel & pinion 325, and a movement barrel 320 are disposed on the "front side" of the movement 100. A switching mechanism (not shown) which includes a setting lever, a yoke, and a yoke holder is disposed on the "back side" of the movement 300. Moreover, a barrel bridge (not shown) which rotatably supports the upper shaft portion of the movement barrel 320, a train wheel bridge (not shown) which rotatably supports the upper shaft portion of the third wheel & pinion 326, the upper shaft portion of the second wheel & pinion 327, and the upper shaft portion of the escape wheel 110, a blade bridge (not shown) which rotatably supports the upper shaft portion of the blade 130, and a balance bridge (not shown) which rotatably supports the upper portion of the balance 120 are disposed on the "front side" of the movement 300.

The center wheel & pinion 325 is configured so as to be rotated by the rotation of the movement barrel 320. The center wheel & pinion 325 includes a center wheel and a center pinion. A barrel drum wheel is configured so as to be engaged with the center pinion. The third wheel & pinion 326 is configured so as to be rotated by the rotation of the center wheel & pinion 325. The third wheel & pinion 326 includes a third wheel and a third pinion. The second wheel & pinion 327 is configured so as to rotate once per minute by the rotation of the third wheel & pinion 326. The second wheel & pinion 327 includes a second wheel and a second pinion. The third wheel is configured so as to be engaged with the second pinion. According to the rotation of the second wheel & pinion 327, the escape wheel 110 is configured so as to rotate while being controlled by the blade 130. The escape wheel 110 includes an escape tooth and an escape pin. The second wheel is configured so as to be engaged with the escape pin. The minute wheel 329 is configured so as to rotate according to the rotation of the movement barrel 320. The movement barrel 320, the center wheel & pinion 325, the third wheel & pinion 326, the second wheel & pinion 327, and the minute wheel 329 configures the gear train.

The minute wheel 340 is configured so as to be rotated based on the rotation of a scoop pinion 329 which is mounted on the center wheel & pinion 325. A scoop wheel (not shown) is configured so as to be rotated based on the rotation of the minute wheel 340. According to the rotation of the center wheel & pinion 325, the third wheel & pinion 326 is configured so as to be rotated. According to the rotation of the third wheel & pinion 326, the second wheel & pinion 327 is configured so as rotate once per minute. The scoop wheel is configured so as to rotate once per twelve hours. A slip mechanism is provided between the center wheel & pinion 325 and the scoop pinion 329. The center wheel & pinion 325 is configured so as to rotate once per one hour.

INDUSTRIAL APPLICABILITY

In the detent escapement of the present invention, the energy loss of the balance can be decreased, and it is possible to improve the thinning of the timepiece movement which mounts the detent escapement. In the detent escapement of the present invention, it is possible to decrease influence of the moment of inertia of the blade due to the posture difference in the vertical posture. Therefore, the detent escapement of the present invention can be widely applied to a mechanical wristwatch, a marine chronometer, a mechanical clock, a mechanical wall timepiece, a large mechanical street timepiece, a tourbillion escapement which mounts the detent escapement of the present invention, a wristwatch having the escapement, or the like. In the mechanical timepiece on which the detent escapement of the present invention is mounted, the mainspring can be smaller, or a long-lasting timepiece can be realized by using the barrel drum of the same size.

REFERENCE SIGNS LIST

100: detent escapement
110: escape wheel
120: balance
122: impulse pallet
124: unlocking stone
130: blade
131: locking stone support arm
132: locking stone
133: one side actuating spring support arm
140: one side actuating spring
141: one side actuating spring regulating lever
150: balance spring
162: balance spring adjustment eccentric pin
170: main plate
300: movement (mechanical body)
320: movement barrel
325: center wheel & pinion
326: third wheel & pinion
327: second wheel & pinion

The invention claimed is:

1. A detent escapement for a timepiece comprising:
an escape wheel;
a balance having an impulse pallet which can contact a wheel tooth of the escape wheel and an unlocking stone; and
a blade having locking stone which can contact the wheel tooth of the escape wheel,
wherein the blade includes a locking stone support arm which supports the locking stone, a one side actuating spring which includes a portion capable of contacting the unlocking stone, and a one side actuating spring support arm that supports a base portion of the one side actuating spring and that determines a position of an unlocking stone contact portion which is positioned at a tip of the one side actuating spring,
wherein the blade is configured so as to be rotated in two directions which include a direction in which the locking stone approaches the escape wheel and a direction in which the locking stone is separated from the escape wheel,
wherein the one side actuating spring is configured and arranged such that the base portion thereof is disposed completely on the side opposite to the side of the escape wheel with respect to a reference line connecting a rotation center of the balance and a rotation center of the blade, and
wherein the one side actuating spring is disposed between the locking stone support arm and the one side actuating spring support arm.

2. The detent escapement according to claim 1, wherein a lower surface of the one side actuating spring support arm and a lower surface of the one side actuating spring are positioned in one plane perpendicular to the rotational center axis line of the detent escapement escape wheel and the rotational center axis line of the balance.

3. The detent escapement according to claim 1, wherein a portion, which is continuous to the unlocking stone contact portion of a deforming spring portion of the one side actuating spring, is configured so as to have an angle which is a range of 5° to 45° with respect to the rotation center of the balance and the reference line.

4. The detent escapement according to claim 1, wherein the locking stone support arm is positioned at a side opposite to the one side actuating spring support arm with respect to the reference line.

5. The detent escapement according to claim 1, wherein a width of the locking stone support arm is formed greater than a width of the one side actuating spring support arm, or a thickness of the locking stone support arm is formed thicker than a thickness of the one side actuating spring support arm.

6. The detent escapement according to claim 1, wherein a width of the locking stone support arm is formed thinner than that of the one side actuating spring support arm, and the one side actuating spring support arm includes hollowed out portions.

7. The detent escapement according to claim 1, wherein at least one of the locking stone support arm and the one side actuating spring support arm includes hollowed out portions in order to decrease the moment of inertia of the blade.

8. The detent escapement according to claim 1, wherein the one side actuating spring support arm is formed in a shape which includes one or more curved portions so as to be convex when viewed from the reference line.

9. The detent escapement according to claim 1, wherein the one side actuating spring support arm is configured so that the cross-sectional area thereof is increased from the tip toward the base portion.

10. The detent escapement according to claim 1, further comprising:
a balance spring that applies a force to the blade to rotate the blade in the direction in which the locking stone approaches the escape wheel,
wherein the balance spring is disposed so as to be positioned at the side opposite to the locking stone support arm and the one side actuating spring support arm with respect to the rotation center of the blade.

11. The detent escapement according to claim 1, further comprising:
a balance spring that applies a force to the blade to rotate the blade in the direction in which the locking stone approaches the escape wheel, and
a balance spring adjustment eccentric pin that adjusts an initial position of the balance spring.

12. The detent escapement according to claim 1, wherein a one side actuating spring regulating lever that presses the unlocking stone contact portion of the one side actuating spring to the one side actuating spring support arm is provided in the blade.

13. A mechanical timepiece comprising:
a mainspring;
a gear train which is rotated by a rotational force when the mainspring is rewound; and
a detent escapement according to claim 1 that controls the rotation of the gear train.

* * * * *